US011643815B2

(12) United States Patent
Oliver et al.

(10) Patent No.: US 11,643,815 B2
(45) Date of Patent: May 9, 2023

(54) MODULAR DECK APPARATUS

(71) Applicant: Oliver Technologies, Inc., Hohenwald, TN (US)

(72) Inventors: Scott Oliver, Linden, TN (US); John Oliver, Linden, TN (US); Daniel Oliver, Linden, TN (US); Emily Oliver, Linden, TN (US)

(73) Assignee: Oliver Technologies, Inc., Hohenwald, TN (US)

( * ) Notice: Subject to any disclaimer, the term of this patent is extended or adjusted under 35 U.S.C. 154(b) by 0 days.

(21) Appl. No.: 17/589,304

(22) Filed: Jan. 31, 2022

(65) Prior Publication Data

US 2022/0154461 A1 May 19, 2022

Related U.S. Application Data

(63) Continuation of application No. 16/825,786, filed on Mar. 20, 2020, now Pat. No. 11,268,276.

(60) Provisional application No. 62/963,312, filed on Jan. 20, 2020, provisional application No. 62/821,058, filed on Mar. 20, 2019.

(51) Int. Cl.

| | |
|---|---|
| ***E04F 11/00*** | (2006.01) |
| ***E04B 5/38*** | (2006.01) |
| ***E04F 11/022*** | (2006.01) |
| ***E04F 11/18*** | (2006.01) |
| ***E04F 11/104*** | (2006.01) |
| ***E04F 11/025*** | (2006.01) |
| ***E04B 1/00*** | (2006.01) |

(52) U.S. Cl.

CPC ..... *E04B 5/38* (2013.01); *E04B 1/003* (2013.01); *E04F 11/002* (2013.01); *E04F 11/022* (2013.01); *E04F 11/025* (2013.01); *E04F 11/104* (2013.01); *E04F 11/181* (2013.01)

(58) Field of Classification Search

CPC ..... E04F 11/022; E04F 11/104; E04F 11/025; E04F 11/112; E04F 11/035; E04F 11/02; E04F 11/18; E04F 2011/005; E04F 2011/007; E04B 1/003

See application file for complete search history.

(56) References Cited

U.S. PATENT DOCUMENTS

| | | | |
|---|---|---|---|
| 3,693,754 | A | 9/1972 | Butler et al. |
| 3,698,511 | A | 10/1972 | Dohan et al. |
| 3,808,757 | A | 5/1974 | Greenwood et al. |
| 4,347,638 | A | 9/1982 | Weaver et al. |
| 4,418,792 | A | 12/1983 | Cerone et al. |
| 4,691,484 | A | 9/1987 | Wilson et al. |
| 4,747,243 | A | 5/1988 | Anstead et al. |
| 4,759,162 | A | 7/1988 | Wyse et al. |

(Continued)

*Primary Examiner* — Kyle J. Walraed-Sullivan

(74) *Attorney, Agent, or Firm* — Baker Donelson; Carl M. Davis, II

(57) ABSTRACT

A deck apparatus for assembly with a pair of opposing brace frames interconnected by a pair opposing connector bases and a deck board top frame having a plurality of deck boards disposed thereon, the connector bases having opposing posts for being received in openings in a lower end of the opposing brace frames ends and the deck board top frame having posts for being received in an upper end of the opposing brace frames, and optionally attaching a stairs riser having a plurality of spaced-apart treads or a ramp riser for extending from a deck surface at a height to a vertically lower support surface.

24 Claims, 17 Drawing Sheets

(56) References Cited

U.S. PATENT DOCUMENTS 4,807,317 A * 2/1989 Quinn ..... E04F 11/181 404/43
4,823,529 A 4/1989 Canfield et al.
4,852,309 A 8/1989 Stamp, Sr. et al.
D356,164 S 3/1995 Rinke et al.
5,653,459 A 8/1997 Murphy et al.
5,848,501 A * 12/1998 Taipale ..... E04F 11/002 52/126.6
5,937,971 A * 8/1999 Storm ..... B66B 9/0869 187/245
6,427,403 B1 8/2002 Tambakis et al.
6,763,912 B2 7/2004 Robinson et al.
7,353,639 B2 * 4/2008 Carson ..... E04H 3/28 52/79.5
7,500,335 B1 3/2009 Kjose et al.
7,607,186 B1 * 10/2009 Mitchell ..... E04F 11/181 52/174
8,627,926 B2 1/2014 Gordon et al.
10,309,091 B2 6/2019 Mcnamee et al.
10,358,871 B2 7/2019 Honeycutt et al.
10,640,983 B2 5/2020 Honeycutt et al.
10,736,304 B2 8/2020 Sarver et al.
2002/0144364 A1 * 10/2002 Anderson ..... E01D 15/24 14/69.5
2002/0153201 A1 10/2002 Warford et al.
2003/0167701 A1 9/2003 Rich et al.
2004/0040229 A1 3/2004 Torch et al.
2004/0050010 A1 * 3/2004 Fortier ..... E04B 1/003 52/650.3
2004/0133998 A1 * 7/2004 Sloniker ..... B65G 69/30 14/69.5
2006/0010621 A1 * 1/2006 Wentz ..... A61G 3/061 14/69.5
2006/0059636 A1 * 3/2006 Suggate ..... E04G 1/152 14/69.5
2009/0205906 A1 8/2009 Schwoerer et al.
2010/0294593 A1 * 11/2010 Gordon ..... E04F 11/02 182/115
2011/0198153 A1 8/2011 Dufour et al.
2012/0036653 A1 * 2/2012 Peters ..... E04F 11/002 14/69.5
2013/0055511 A1 * 3/2013 McGivern ..... E04F 11/002 14/69.5
2013/0198978 A1 * 8/2013 Pohlman ..... E01D 1/00 29/428
2014/0150188 A1 * 6/2014 Allen ..... E04F 11/1865 256/65.03
2015/0176286 A1 * 6/2015 Suggate ..... E04B 1/34331 14/69.5
2016/0251858 A1 * 9/2016 Suggate ..... E04F 11/002 14/69.5
2018/0022262 A1 1/2018 Roth et al.
2018/0119436 A1 * 5/2018 Bailie ..... E04G 7/28
2019/0119923 A1 * 4/2019 Winter ..... E04F 11/1808
2019/0186150 A1 6/2019 Michels et al.
2020/0299958 A1 9/2020 Oliver et al.
2021/0164232 A1 * 6/2021 Bonner ..... E04F 11/1865
2021/0395993 A1 * 12/2021 Wagner, III ..... E04F 15/02411

* cited by examiner

MODULAR DECK APPARATUS

TECHNICAL FIELD

The present invention relates to free-standing deck apparatus. More particularly, the present invention relates to modular deck apparatus that readily assembles with one or more component frames and decking for a deck module, a deck ramp module, and a stairs module.

BACKGROUND OF THE INVENTION

Often residential homes, shopping facilities, community centers such as pools and outdoor facilities, and office building complexes feature elevated deck structures. These decks provide ornamental and architectural appearances for the buildings and grounds as well as stable expanded usable space for entertaining, work, play and access to the adjacent facility and grounds. Typically, deck structures are designed and constructed with foundational supports, joists and decking secured for bearing loads imposed by persons engaged in activities on the deck. Stairs facilitate access to the elevated deck, and decks offer ornamental and structural features including multiple levels, deck board placements for designs, and built-in seating.

Typically, decks for home, offices and grounds are constructed according to engineering designs that account for loading, wind resistance, and stable foundational support. Alternatively, low height decks may be constructed as free-standing structures, in which the deck mass provides resistance to movement. There are a variety of components available for constructing decks including elongated boards for decking, beams for foundational support. stair risers that support in spaced-relation vertically and lateral offset treads, and railings that attach together with fasteners to support post. Stability requirements may necessitate foundational supports for low-height decks such as poured concrete footers having metal connecters to beams and molded concrete stabilizer blocks arranged in space-relation. Metal brackets, connectors, hangers, and fasteners join components of the decks together for a rigid stable structure. Deck boards may be wood or alternatively in recent years, plastic or composite material boards have become popular for longevity and weather resistance which may reduce periodic maintenance requirements.

Deck structures may be a desired feature for manufactured buildings such as mobile homes or offices. These manufactured buildings are typically installed above grade and supported by piers and ground anchors that connect to elongated longitudinal support beams of the manufactured building. The support beams are spaced-apart and provide a support for a floor having transverse joists and floor decking and from which the side walls extend to a roof for enclosing the building. During installation of the manufactured building at a site, a crew of installers place a foundation of a plurality of vertical piers between the ground surface and the support beams, for transferring loading from the manufactured building to the ground. The pier may seat on a rigid ground pan or connect to a footer in the ground such as for areas subject to ground freeze in winter weather. Because these buildings are installed at a height relative to the underlying ground surface, stairs or steps may be required for entrance and egress.

U.S. Pat. No. 6,634,150 discloses a foundation that provides resistance to lateral or longitudinal forces that may be exerted on the manufactured building, such as by strong winds or earthquakes. A lateral brace pivotably attaches at a lower end to the ground pan under one of the support beams and attaches at an upper end to the other of the support beams. A separate pier is installed on the ground pan contacts the support beam above the ground pan. The lateral brace enables the ground pan to resist lateral forces on the manufactured building while the pier supports the manufactured building. Similarly, the brace may be connected between the ground pan and the support beam over the ground pan, for resisting movement caused by longitudinal forces on the manufactured building.

The ground surface typically slopes, so the piers are of different heights for positioning the manufactured building level. The height of the doorway into building is in a range of about 1 foot to about 4 feet above the ground surface, and typically in a range of about the 2 feet to 3 feet height relative to the ground. Depending on the height of the door opening to the manufactured building, the stairs structure, or stairs with a small landing area, may be installed, for access to the building. Also, persons using mobility devices (crutches, canes, wheelchairs or scooter devices (powered or manual)) may find stairs difficult, and so buildings may be provided with ramps gently sloped to facilitate entrance and egress. Many organizations and construction guidelines provide for a 4 to 7 degree incline, preferably 1:12 or about 5 degrees incline.

Alternatively, an owner of the building may contract separately for construction of a deck with stairs for an area proximate the building and for a landing area for entrance into the building and egress. Often the deck is installed by a separate decking installation crew, and it may be some several days or weeks between the installation of the manufacture building, for example, and the installation of a deck and stairs. For the interim period, temporary stairs may be used, but such is not preferred.

Also, as noted above, component products from which decks and stairs may be constructed are typically available from home improvement stores. These components include wooden stair risers, deck boards (both wood and composite) for treads and deck surface, metal braces, hangers and fasteners, railings and posts, and blocks, support beams, and concrete for foundations and supports. Nevertheless, these deck components have the drawback of in-field custom measuring, cutting and constructing.

There is a need in the art for a deck, ramp, and stairs apparatus that readily assembles and installs in the field for buildings with minimal different components that do not require alterations or the use of specialized tools. It is to such that the present invention is directed.

SUMMARY OF THE INVENTION

The present invention meets the need in the art by providing a deck module readily assembled and installed in the field to provide a deck structure for a building. The deck module comprises a deck apparatus, comprising a pair of opposing brace frames, each brace frame having two opposing vertical members connected by a transverse member. The pair of opposing brace frames connect together in spaced relation with a pair of opposing connector bases. Each connector base has an elongated member with a pair of posts extending in a first direction from respective end portions of the elongated member, the pair of posts for being received in a respective open end of the vertical members of the opposing brace frames to hold the brace frames in spaced-relation. A deck walking surface is provided by a deck board top frame having opposing end members and opposing side members attached at respective distal ends, with a plurality of projecting deck posts each extending from a respective connection of one of the end members and one of the side members, and each of the deck posts for being received in an opposing upper end of a respective one of the vertical members of the opposing brace frames. A ramp assembly for being attached at a first end proximate the deck board top frame and an opposing second end for bearing on a support surface vertically lower than the deck board top frame after attaching the first end thereto, said ramp assembly. The ramp assembly comprising: a plurality of ramp brace frames, each ramp brace frame having two opposing vertical ramp members connected by a transverse ramp member, the vertical ramp members in a first one of the plurality of ramp brace frames having a first length and the vertical ramp members in each of a subsequent one of the plurality of ramp brace frames having a respective second length, said respective second length less than the first length and said respective second length of a first one of a subsequent plurality of the ramp brace frames greater than the second length of a second one of the subsequent plurality of ramp brace frames; a plurality of ramp connector bases, each ramp connector base having an elongated base member with a pair of base posts extending at an oblique angle in a first direction from respective end portions of the elongated base member, the base posts for being received in a respective open end of a respective first vertical ramp member of a first one of the plurality of ramp brace frames and in a respective open end of a respective second vertical ramp member of a second one of the plurality of ramp brace frames to hold said first and second one of the plurality of ramp brace frames in spaced apart relation; and a ramp deck board top frame having opposing end members and opposing side members attached at respective distal ends, a plurality of projecting ramp deck posts each extending from a respective connection of one of the end members and one of the side members, each of the ramp deck posts for being received in an opposing upper end of a respective one of the vertical ramp members of said first and second ones of the plurality of ramp brace frames in spaced apart relation. A plurality of deck boards for disposing in adjacent relation between the end members of the deck board top frame and the ramp deck board top frame.

In another aspect, the present invention provides a deck apparatus, comprising a pair of brace frames, each brace frame having two opposing vertical members connected by a transverse member, said base frames for disposing in opposing spaced relation and a pair of connector bases at a first end and a second end to a respective one of the brace frames for holding the brace frames in spaced-relation. A deck board top frame having opposing end members and opposing side members attached at respective distal ends, and configured for receiving the respective upper ends of the vertical members of the opposing brace frames held in spaced-apart relation. A ramp assembly for being attached at a first end proximate the deck board top frame and an opposing second end for bearing on a support surface vertically lower than the deck board top frame after attaching the first end thereto. The ramp assembly comprising a plurality of ramp brace frames, each ramp brace frame having two opposing vertical ramp members connected by a transverse ramp member, the vertical ramp members in a first one of the plurality of ramp brace frames having a first length and the vertical ramp members in each of a subsequent one of the plurality of ramp brace frames having a respective second length, said respective second length less than the first length and said respective second length of a first one of a subsequent plurality of the ramp brace frames greater than the second length of a second one of the subsequent plurality of ramp brace frames. A plurality of ramp connector bases each connectable at a first end and a second end to a respective first and second one of the plurality of ramp brace frames for holding said first and second one of the plurality of ramp brace frames in spaced apart relation. A ramp deck board top frame having opposing end members and opposing side members attached at respective distal ends configured for receiving the respective upper ends of the vertical ramp members of said first and second ones of the plurality of ramp brace frames. A plurality of deck boards for disposing in adjacent relation between the end members of the deck board top frame and the ramp deck board top frame.

Objects, advantages and benefits of the invention may be readily ascertained upon a reading of the following detailed description in conjunction with the drawings.

DETAILED DESCRIPTION OF AN ILLUSTRATIVE EMBODIMENT

Figure 1:
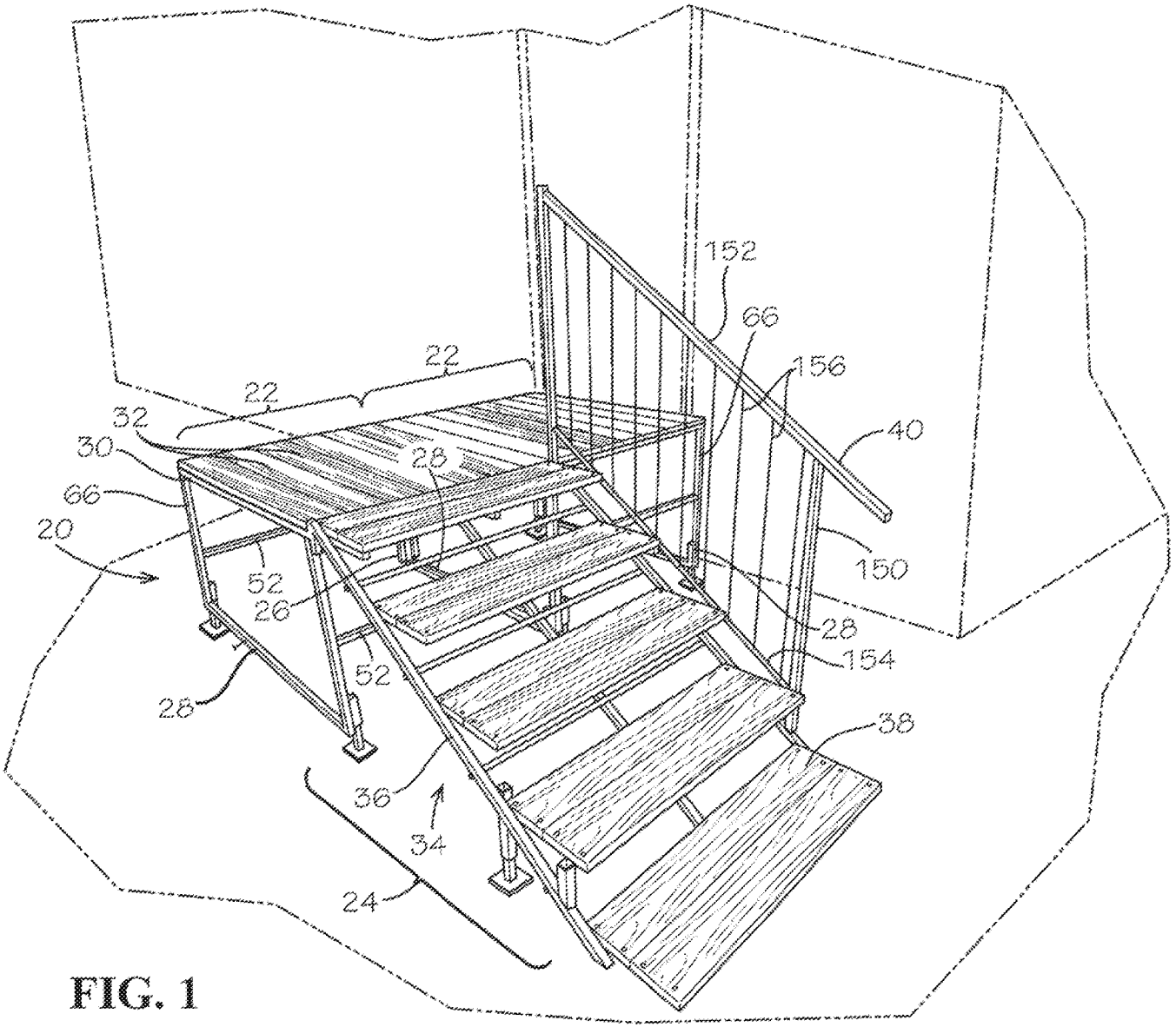
FIG. 1 illustrates a modular decking apparatus that assembles with a deck module and a stairs module for installation of a free-standing deck according to the present invention.

With reference to the drawings, in which like parts have like identifiers, FIG. 1 illustrates a modular decking apparatus 20 that assembles with a deck module 22 and a stairs module 24 for installation of a deck that may be free-standing on a ground surface 25, according to the present invention, in proximity to a building 27 with a doorway 29. The deck module 22 has a pair of opposing brace frames 26 joined by opposing connector bases 28 and a top frame 30 to which a plurality of deck boards 32 attach.

The stairs module 24 has a stair riser 34 with a pair of opposing spaced-apart riser arms 36 from which supports extend for holding a pair of deck boards as treads 38. A railing 40 orientated at an angle attaches to the riser arms 36 for lateral framing of the stairs module 34 (one railing 40 is shown).

Figure 2D:
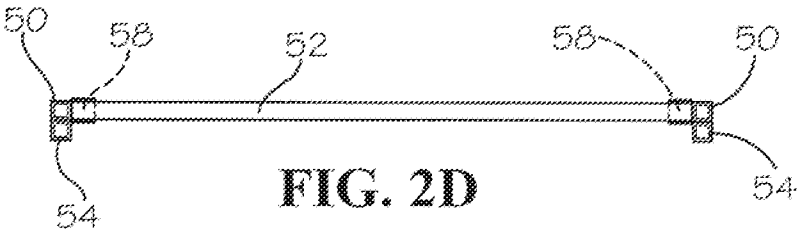
FIGS. 2A-2D illustrate a brace frame for the deck module illustrated in FIG. 1 in perspective, front elevational, side elevational, and top plan views.
Figure 2B:
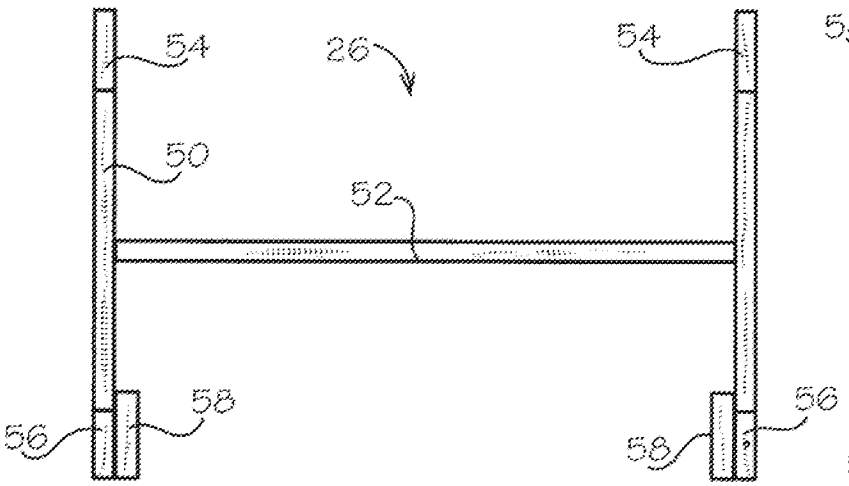
Figure 2C:
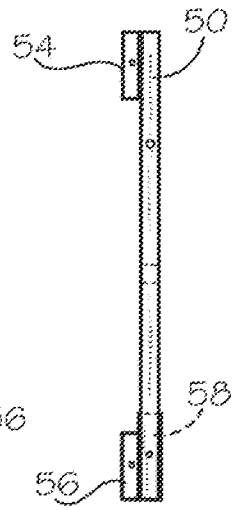
Figure 2A:
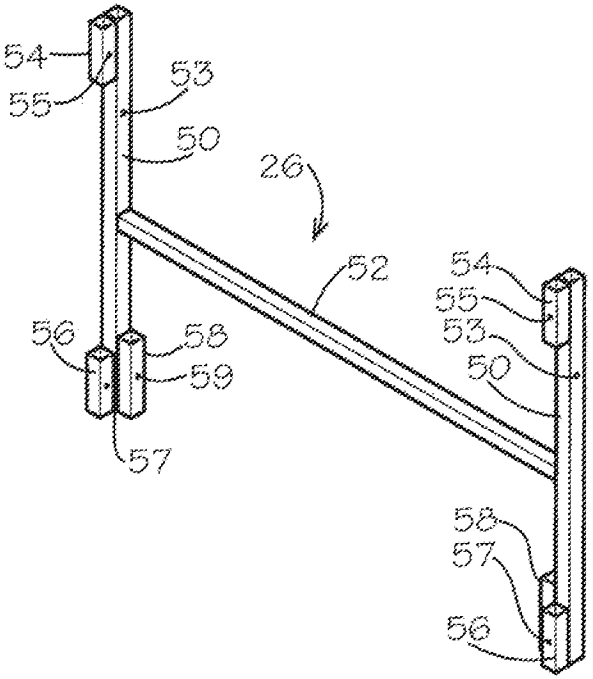

FIG. 2A illustrates in perspective view the brace frame 26 for the deck module illustrated in FIG. 1, while FIGS. 2B-2D illustrate the brace frame in front elevational, side elevational, and top plan views, respectively. The brace frame 26 includes two opposing spaced-apart vertical members 50 joined by a span 52. The vertical members 50 are elongated square tubing and open at opposing ends. The span 52 welds to the vertical members 50. An inner face of the vertical member 50 includes a fastener guide hole 53. A pair of receivers 54, 56 attach in spaced relation at opposing distal ends on an outward face of each of the vertical members 50. The receivers 54, 56 are open-ended tubes and include a fastener guide hole 55, 57. The receivers 54 receive a connector base 28 for an adjacent deck module 22. The receivers 56 receive pegs or posts extending from the top frame 28 discussed below. The brace frame 26 as configured thus provides a support for one deck module or alternatively for two adjacent deck modules as discussed below. The guide holes 55, 57 on one vertical member are formed on a face transverse to the guide holes for the receivers on the opposing vertical member. A leg receiver 58 attaches to an inward face of the vertical member 50 and includes a fastener guide hole 59.

Figure 3D:
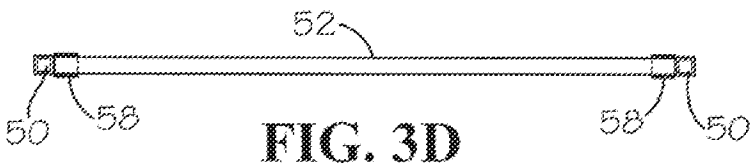
FIGS. 3A-3D illustrate a second brace frame for the deck module illustrated in FIG. 1 in perspective, front elevational, side elevational, and top plan views.
Figure 3B:
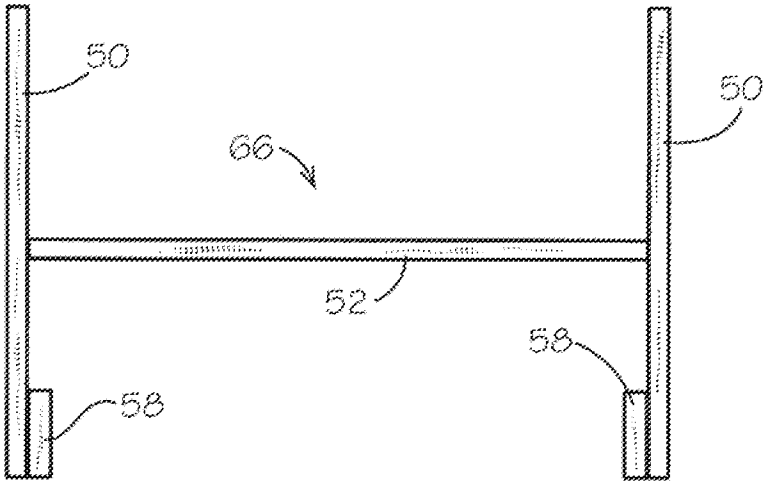
Figure 3C:
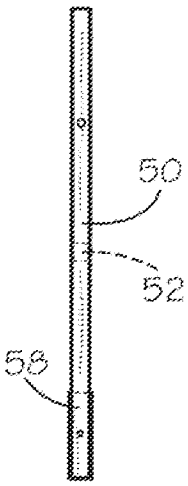
Figure 3A:
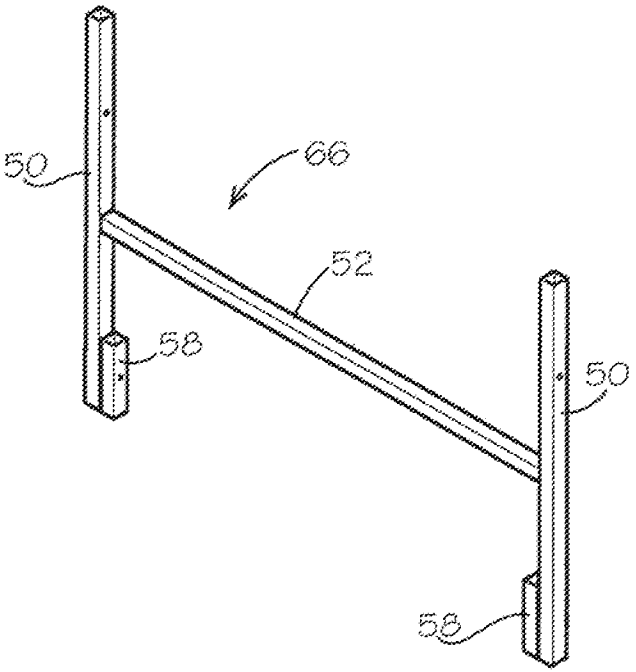

FIG. 3A illustrates in perspective view an alternate embodiment 66 of the brace frame 26 for the deck module illustrated in FIG. 1, while FIGS. 3B-3D illustrate the brace frame 66 in front elevational, side elevational, and top views, respectively. The brace frame 66 is the same as the brace frame 26, but does not includes the pair of receivers 54, 56. A particular embodiment of a single deck module 22 uses two of the brace frames 66; another embodiment configured for joining adjacent deck modules uses one of the brace frames 66 and one of the brace frames 26.

Figure 4B:
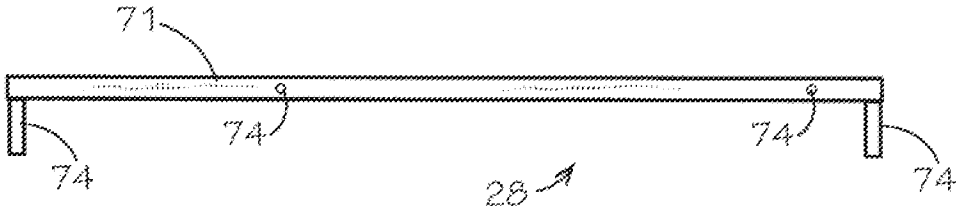
FIGS. 4A-4D illustrate a connector base for the deck module illustrated in FIG. 1 in perspective, front elevational, side elevational, and top plan views.
Figure 4C:
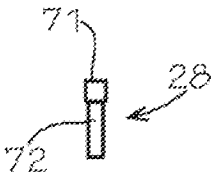
Figure 4D:
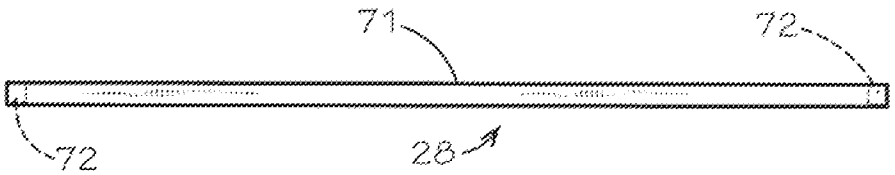
Figure 4A:
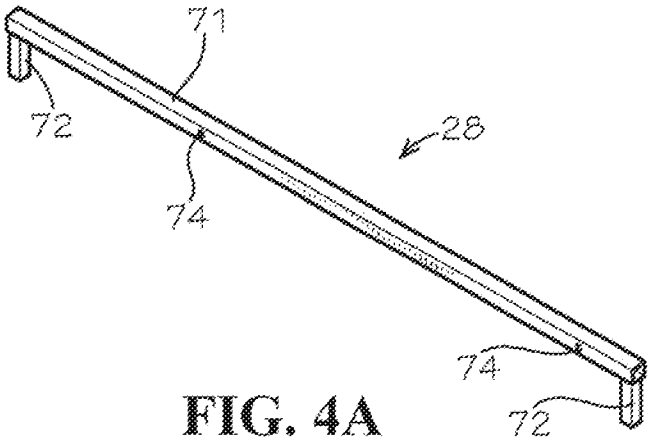

FIG. 4A illustrates the connector base 28 in perspective view for interconnecting a pair of the opposing brace frames 26 (or 66). FIGS. 4B-4D illustrate the connecter base 28 in front elevational, side elevational, and top views, respectively. The connector base 28 is an elongated tube 71 having projecting legs 72 attached at respective distal ends and extending perpendicularly in a first direction. A pair of holes 74 are formed in spaced relation in a side face of the connector base 28. The legs 72 insert into the lower open end of the vertical members 50 in opposing brace frames 26, 66. Fasteners extending through aligned holes 74 maintain adjacent modules 22 square and together so the deck remains level while adjustable feet members enable adjusting the supported height of the deck by bearing on the ground 25.

Figure 5C:
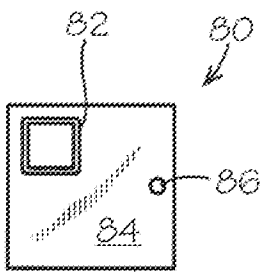
FIGS. 5A-5C illustrate a leg for selectively adjusting the height of the deck module illustrated in FIG. 1 in perspective, front elevational, and top plan views.
Figure 5B:
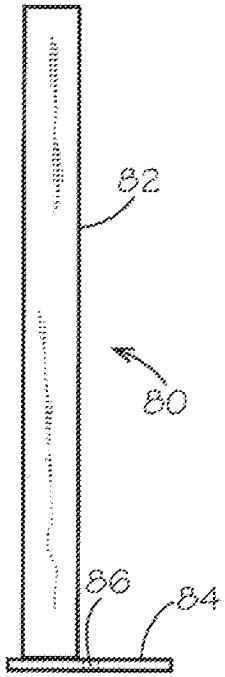
Figure 5A:
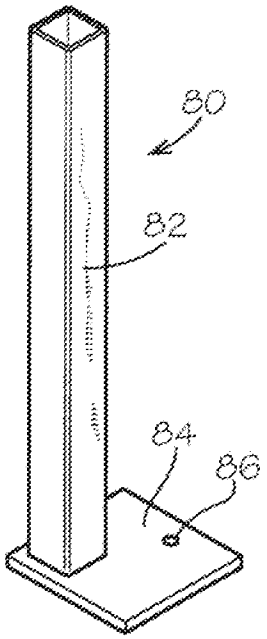

With reference to FIGS. 5A-5C, a plurality of legs 80 may be used for disposing the deck module 22 a selected vertical distance from the ground surface 25. FIG. 5A illustrates the height adjusting leg 80 in perspective view. FIGS. 5B and 5C illustrate the leg 80 in front elevational and top plan views, respectively. The leg 80 includes an elongated vertical member 82 attached to a lateral corner portion of a plate 84 as a foot that contacts the ground surface 25. The size of the plate may be selected depending on soil conditions; for example, a larger area plate is preferable for softer (sandy) soil while a smaller area plate may be sufficient support on a more dense (clay) soil. The vertical member 82 slides in the open end of the receiver 58 of the base fame 26. A fastener extending through the opening 57 engages the vertical member 82 to secure the leg 80 at a selected positon relative to the base frame 26 for positioning the base frame vertically from the ground 25 but maintain the deck surface level. The plate 84 includes an opening 86. A stake or a lag screw (not illustrated) may be inserted through the opening 86 and into the ground or for example securing into concrete, asphalt, or wood, resists movement of the leg 80 relative to the ground.

Figure 6D:
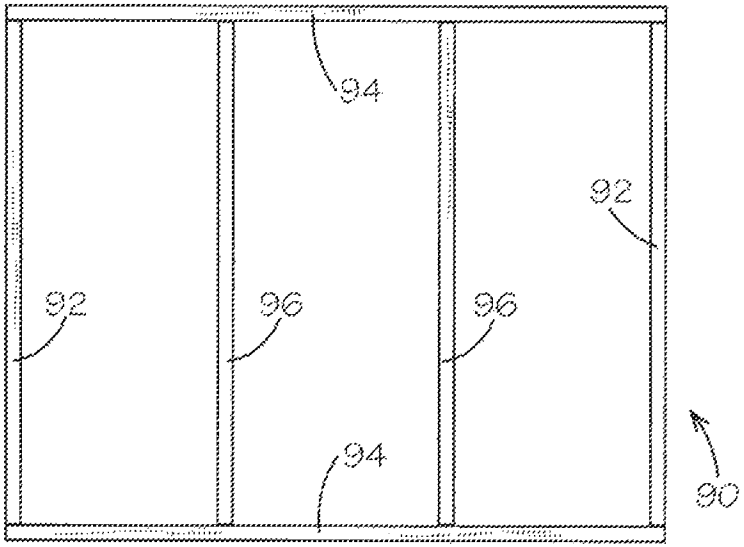
FIGS. 6A-6D illustrate a top frame for the deck module illustrated in FIG. 1 in perspective, front elevational, side elevational, and top plan views.
Figure 6C:
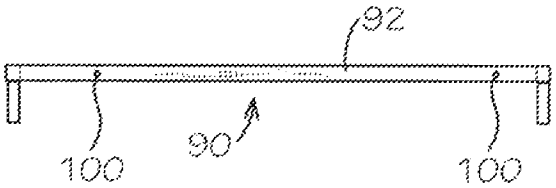
Figure 6A:
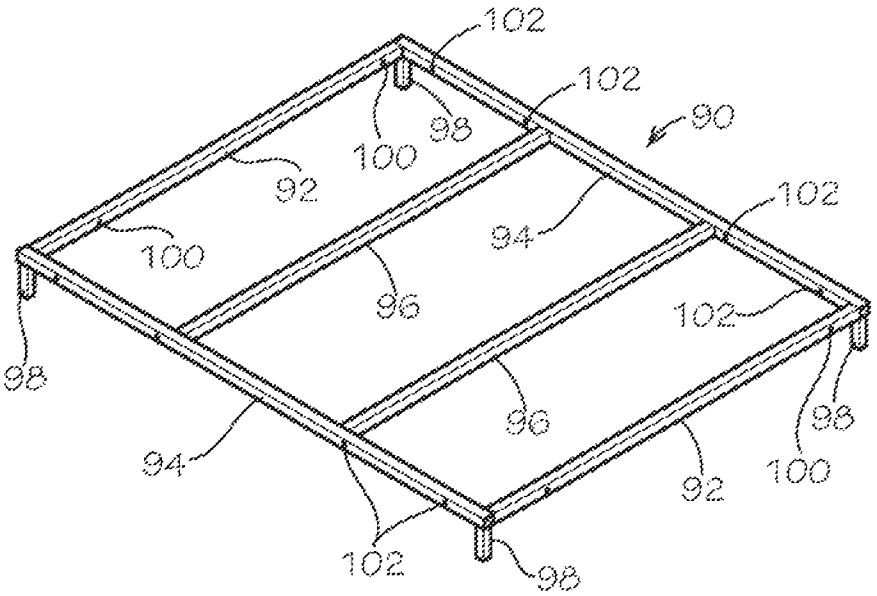
Figure 6B:
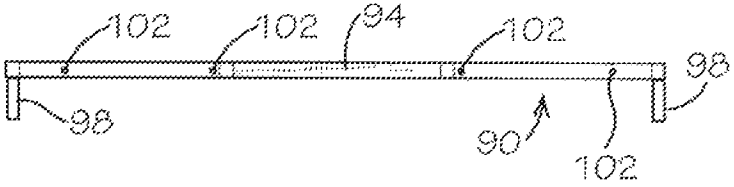

FIG. 6A illustrates a top frame 90 that provides a deck platform for the deck module 22 illustrated in FIG. 1. FIGS. 6B-6C illustrate the top frame 90 in front elevational, side elevational, and top plan views, respectively. The top frame 90 includes opposing end members 92 connected at respective distal ends to opposing side members 94 with a plurality of spaced-apart transverse support members 96 attached at distal ends to the side members. A post 98 extends from each of the corner distal ends of the attached end and side members 92, 94. The end members 92 include a pair of spaced-apart holes 100. The side members 94 include a pair of spaced-apart holes 102. In the illustrated embodiment, the side members 94 include two sets of the pairs of holes 102. The holes 100 and 102 are spaced a pre-determined distance apart for receiving fasteners to secure adjacent deck module 22 together. As discussed below, the deck boards 32 shown in FIG. 1 attach with fasteners to the upper surface of the top frame 90. The posts 98 insert into the open upper ends of the brace frames 26, 66 for the deck module 22. In an application having multiple deck modules 22 in adjacent relation, the posts on one side of the top frame 90 insert into the upper receivers 54 of the brace frame 26 of the adjacent deck module.

The opposing brace frames 26, (66), the connector bases 28, and the top frame 90 define a deck module box for the deck module 22. The boxes of adjacent deck modules 22 interconnect together for rigidity and stability of the free-standing deck and to maintain the deck surface level, with fasteners that connect adjacent braces, adjacent connector bases, and adjacent portions of the respective top frames.

Decks above the ground surface 25 may require side railings for preventing persons from stepping off or falling off the elevated deck. The modular deck apparatus of the present invention includes an elongated railing 150 (discussed below and shown in FIGS. 10A-10E), and one or more railings 150 may be interconnected and supported on the deck module with selected end posts 112 (discussed below and shown in FIGS. 9A-9F) midposts 114 (discussed below and shown in FIGS. 8A-8F), and corner posts 116 (discussed below and shown in FIGS. 7A-7F).

Figure 7A:
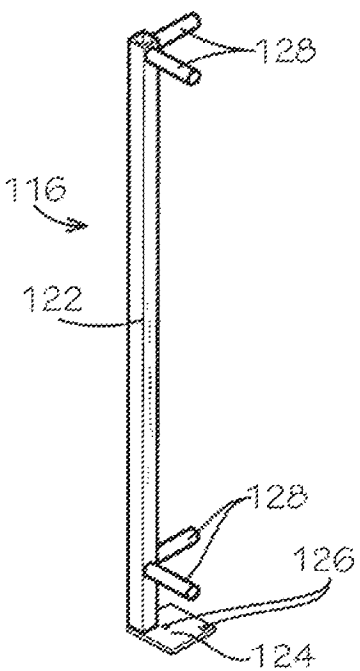
FIGS. 7A-7D illustrate a corner post for supporting a railing installed on the deck module illustrated in FIG. 1 in perspective, front elevational, side elevational, and top plan views.
Figure 7B:
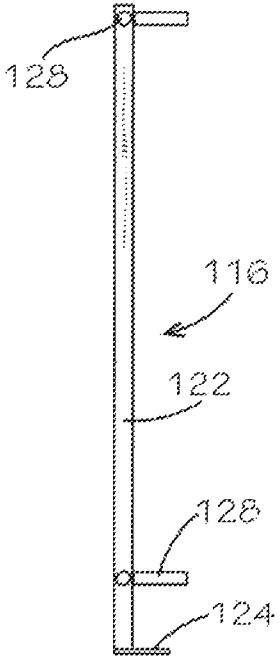
Figure 7C:
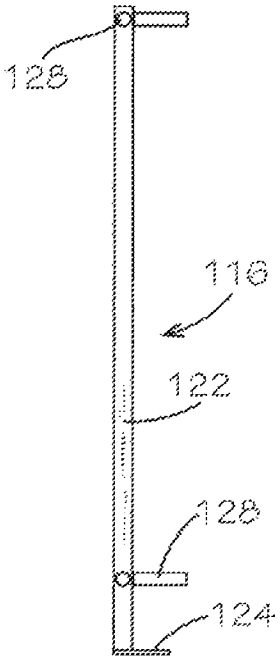
Figure 7D:
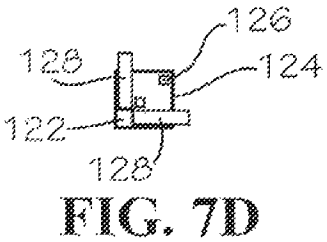
Figure 7E:
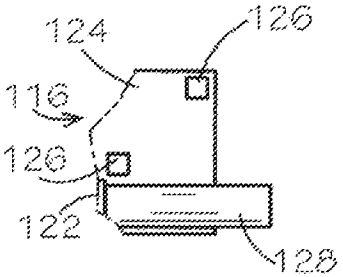
FIG. 7E is a detailed top plan view of FIG. 7B showing features of a footer plate.
Figure 7F:
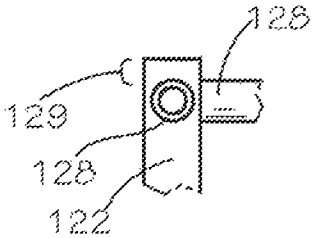
FIG. 7F is a detailed front view of an upper end portion of the corner post illustrated in FIG. 7A.

FIGS. 7A-7D illustrate the corner post 116 for supporting a railing installed on the deck module illustrated in FIG. 1, in perspective, front elevational, side elevational, and top views, respectively. The corner post 116 supports a pair of railings that extend therefrom in perpendicular planes. The corner post 116 includes a post 122 with a footer plate 124 attached at a bottom end. The footer plate 124 includes a pair of spaced-part openings 126 for receiving fasteners to secure the corner post 116 to the deck boards 32. Two pairs of stubs 128 attach to and extend from respective transverse faces of the post 122 at upper and lower portions of the post. The first pair of stubs 128 are spaced a predetermined distance from the second pair of stubs. FIG. 7E is a detailed top plan view of FIG. 7B illustrating the footer plate 124 and openings 126. FIG. 7F is a detailed front view of an upper portion of the connector post 116 shown in FIG. 7A illustrating a gap 129 or space between a distal end of the post 122 and the stub 128, for accommodating a hand rail of a railing level with the distal end, as discussed below.

Figure 8D:
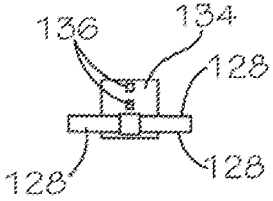
FIGS. 8A-8D illustrate a midpost for supporting ends of opposing railings installed on the deck module illustrated in FIG. 1 in perspective, front elevational, side elevational, and top plan views.
Figure 8E:
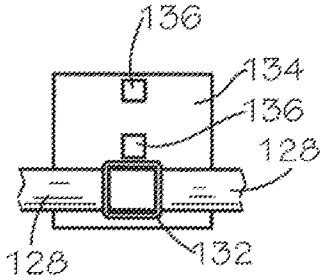
FIG. 8E is a detailed top plan view of FIG. 8B showing features of a footer plate.
Figure 8F:
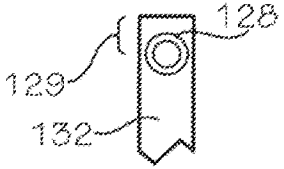
FIG. 8F is a detailed front view of an upper end portion of the midpost illustrated in FIG. 8A.
Figure 8C:
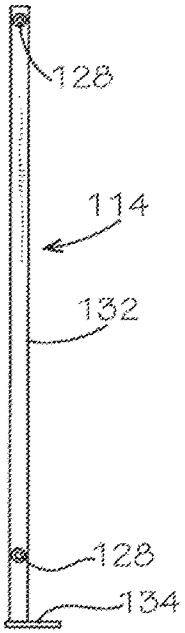
Figure 8B:
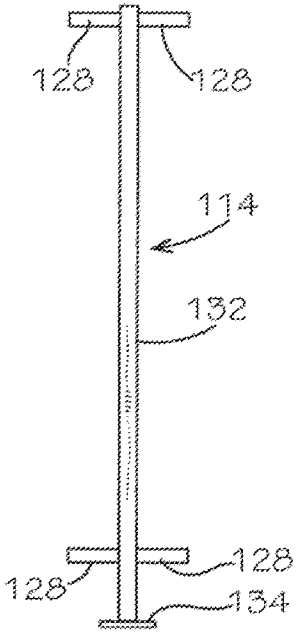
Figure 8A:
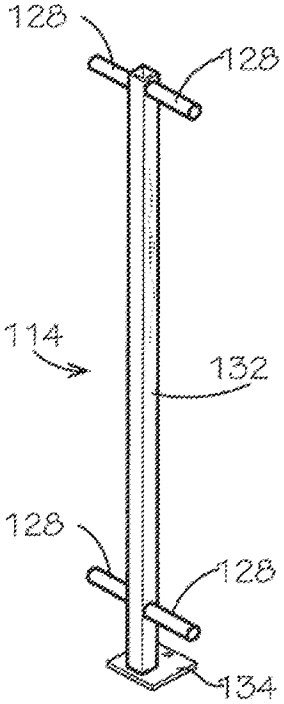

FIGS. 8A-8D illustrate the midpost 114 for supporting ends of opposing railings installed on adjacent deck modules in perspective, front elevational, side elevational, and top plan views, respectively. The midpost 114 includes a post 132 with a footer plate 134 that attaches at a lower or bottom end. The footer plate 134 includes a pair of spaced-part openings 136 for receiving fasteners to secure the midpost 114 to the deck boards 32. Two pairs of stubs 128 attach to and extend from opposing faces of the post 132 at upper and lower portions of the post. The first pair of stubs 128 are spaced the predetermined distance from the second pair of stubs. The stubs 128 in each pair extend coaxially in opposing directions. FIG. 8E is a detailed top plan view of FIG. 8B illustrating the footer plate 134 and openings 136. FIG. 8F is a detailed front view of an upper portion of the midpost 114 shown in FIG. 8A illustrating the gap 129 between a distal end of the post 132 and the stub 128, for accommodating a hand rail of a railing level with the distal end, as discussed below.

Figure 9D:
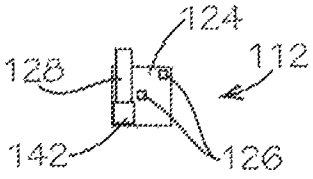
FIGS. 9A-9D illustrate an end post for supporting a railing installed on the deck module illustrated in FIG. 1 in perspective, front elevational, side elevational, and top views.
Figure 9E:
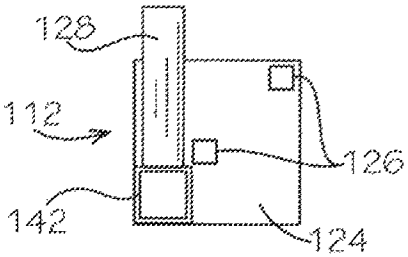
FIG. 9E is a detailed top plan view of FIG. 9B showing features of a footer plate.
Figure 9F:
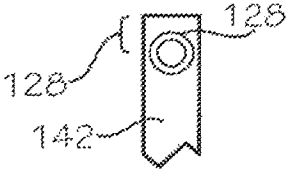
FIG. 9F is a detailed front view of an upper end portion of the end post illustrated in FIG. 9A.
Figure 9C:
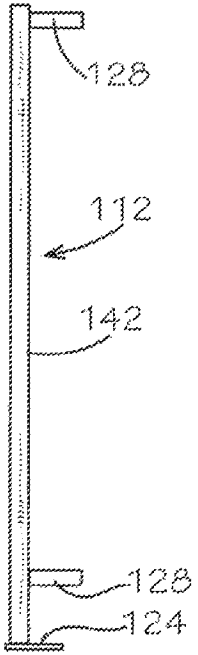
Figure 9B:
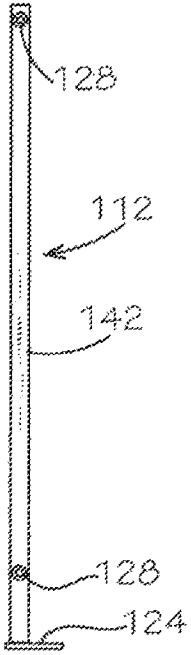
Figure 9A:
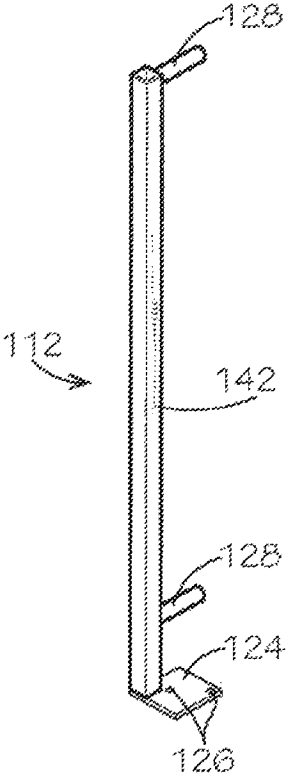

FIGS. 9A-9D illustrate the end post 112 for supporting a railing installed on the deck module illustrated in FIG. 1, in perspective, front elevational, side elevational, and top plan views, respectively. The end post 112 includes a post 142 with the footer plate 124 attached at a lower or bottom end. A pair of stubs 128 attach to and extend in the same direction from the post 142 at upper and lower portions of the post. The stubs 128 are spaced the predetermined distance apart. FIG. 9E is a detailed top plan view of FIG. 9D illustrating the footer plate 124 and openings 126. FIG. 9F is a detailed front view of an upper portion of the end post 112 shown in FIG. 9A illustrating the gap 129 between a distal end of the post 142 and the stub 128, for accommodating a hand rail of a railing level with the distal end, as discussed below.

Figure 10B:
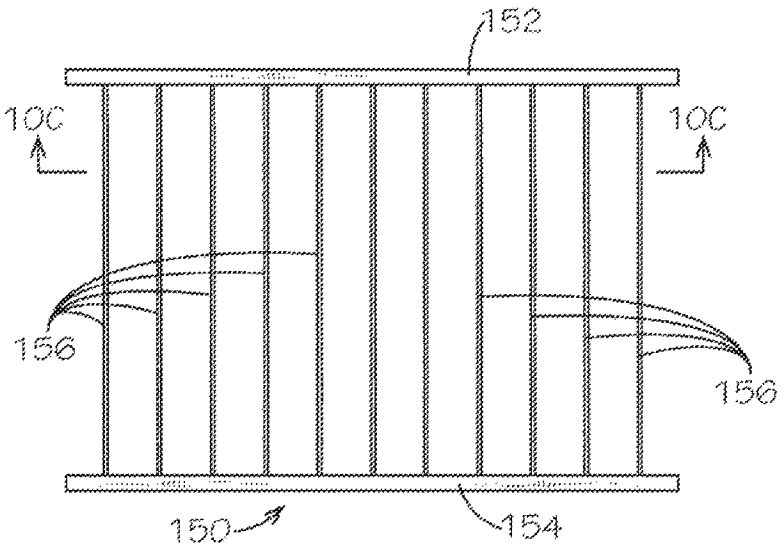
FIGS. 10A-10D illustrate a railing in perspective, front elevational, cross-sectional elevational view taken on lines 10C-10C in FIG. 10B, and side view, for installation on the deck module illustrated in FIG. 1.
Figure 10C:
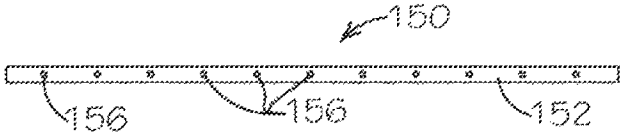
Figure 10E:
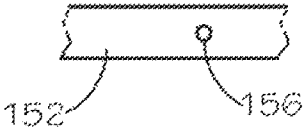
FIG. 10E is a detail view of a portion of a tip rail shown in FIG. 10C.
Figure 10A:
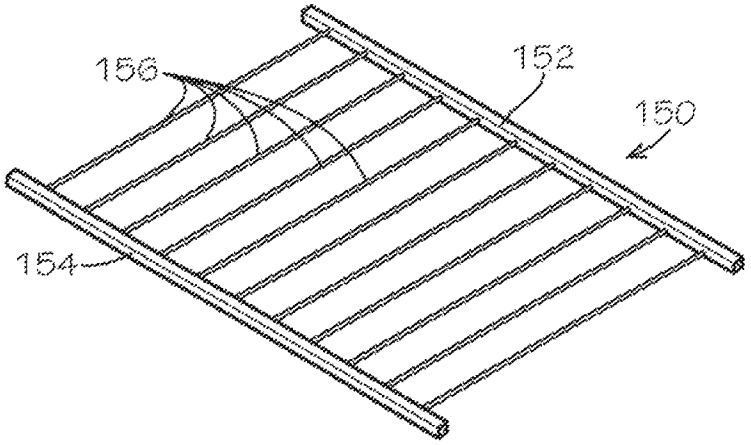
Figure 10D:
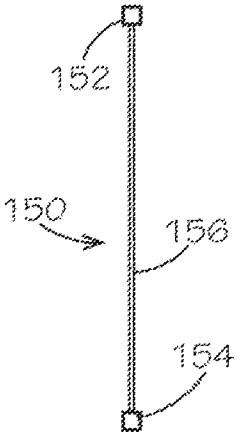

The end post 112, midpost 114 and the corner post 116 connect to and support the railing 150 illustrated in perspective view in FIG. 10A. FIGS. 10B-10D illustrate in the railing 150 in front elevational view, cross-sectional elevational view taken on lines 10C-10C in FIG. 10B, and side view, respectively. FIG. 10E is a detailed cross-sectional view of FIG. 10C. With reference to FIGS. 10A and 10B, the railing 150 includes a top rail 152 and an opposing bottom rail 154. A plurality of spaced-apart rods 156 extend between and attach at distal ends to the rails 152, 154. The rails 152, 154 are tubes with open opposing distal ends. An embodiment uses 1-inch square tubing for the rails. The rods 156 are 0.25 inch diameter steel rods. An alternate embodiment attaches an elongated wood member (not illustrated) as a grippable or hand-slidable hand-rail to the top rail 152.

Figure 11A:
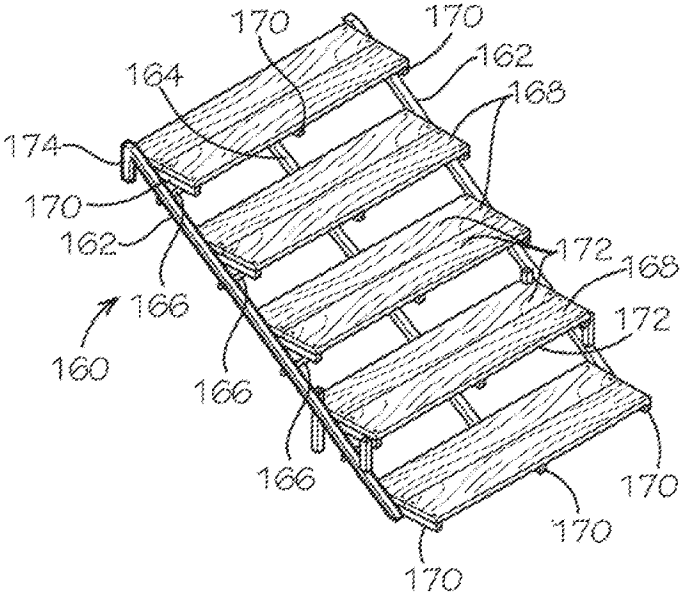
FIGS. 11A-11D illustrates a stair riser for the stair module illustrated in FIG. 1 in perspective, front elevational, side elevational view, and top plan view.
Figure 11B:
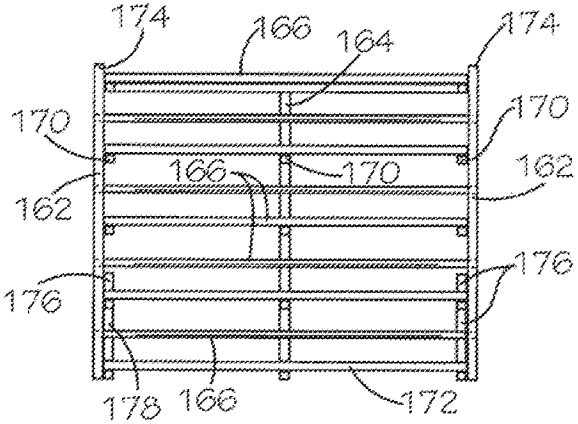
Figure 11C:
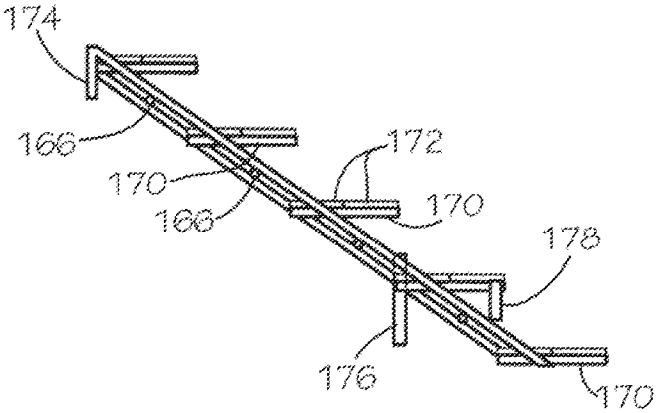
Figure 11D:
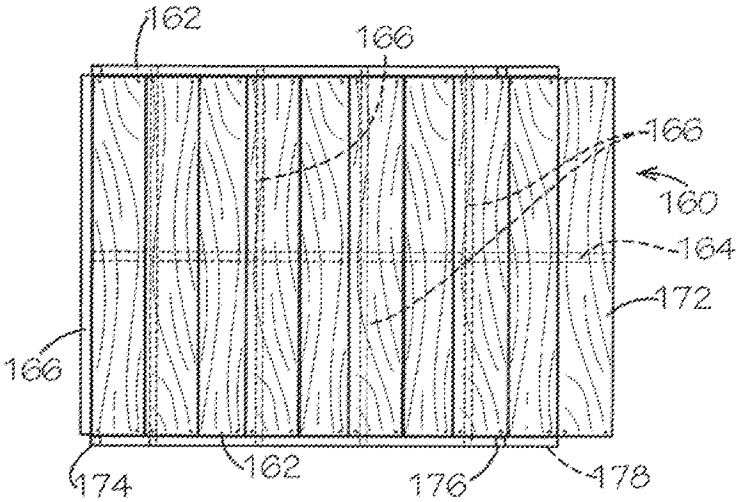

FIG. 11A illustrates in perspective view a stair riser 160 for the stairs module 24 as illustrated in FIG. 1. FIGS. 11B-11D illustrate the stair riser 160 in front elevational, side elevational view, and top plan view, respectively. The stair riser 160 includes opposing riser arms 162 and an intermediate longitudinal support 164. A plurality of transverse support members 166 disposed in spaced-apart relation attach to the riser arms 162 at respective distal ends and to the intermediate support 164. The transverse support members 166 may be angle irons having an L-shape in longitudinal end view. The riser 160 provides for a plurality of steps 168. The illustrated embodiment has five spaced-apart steps 168. Each step 168 has three aligned tread support arms 170 that attach at first ends to the respective riser arms 162 and intermediate support 164 and extend laterally as a cantilever. The tread support arms 170 attach at an oblique angle relative to the riser arm and intermediate support. Treads 172 attach to the support arms 170. In the illustrated embodiment, the treads 172 are elongated 1 inch by 6 inch (nominal) boards cut to length for extending between the support arms 170 on the riser arms 162. A pair of upper railing support tubes 174 attach to the riser arms 162 at an upper end. A pair of leg receiving tubes 176 attach to a lower portion of the riser arms 162. As in the embodiment illustrated in FIG. 1, the leg receiving tubes 176 attach proximate the second tread from the bottom of the stair riser 160, preferably between the lowermost tread and an adjacent second tread. A pair of lower railing support tubes 178 attach on opposing sides between a distal end of the respective tread support arm 170 and the riser arm 162 adjacent leg receiving tube 174. The lowermost tread 170 defines a landing at or proximate the ground surface. In an alternate embodiment, the lowermost tread support arms bolt to the riser arms 170, in order that the lowermost step may be angled towards the ground surface to facilitate walking transition from ground to tread or from tread to ground.

Figure 11E:
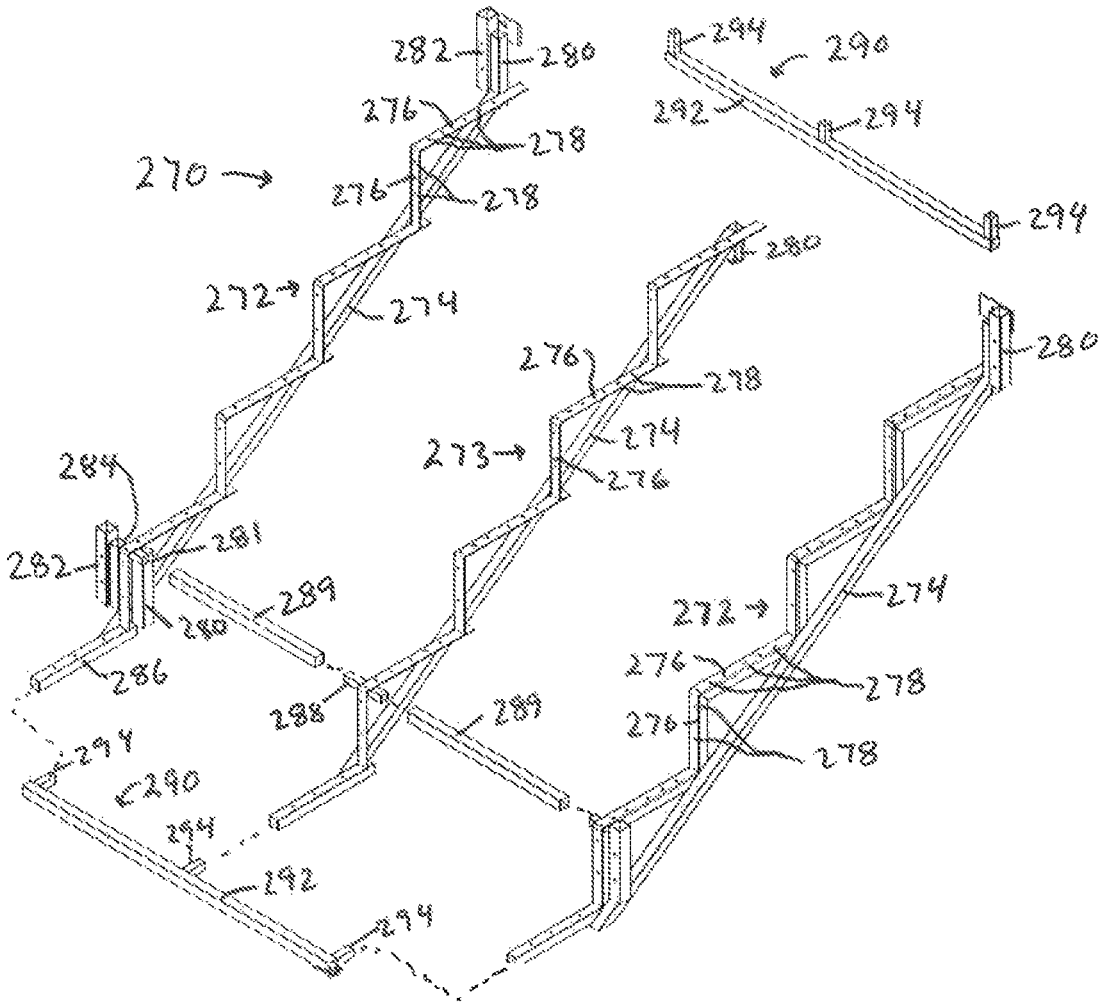
FIG. 11E illustrates in perspective view an alternate embodiment of a stair riser for the star module illustrated in FIG. 1.

FIG. 11E illustrates in perspective view an alternate embodiment of a stair riser 270 for the star module illustrated in FIG. 1. The stair riser 270 includes two outer riser arms 272 and an intermediate riser arm 273 disposed in space-apart relation. The risers 272, 273 comprise elongated tubes 274 with a plurality of angle iron members or plates 276 attached in L-shape stair-step order along a longitudinal length of the riser arm. The horizontal plates 276 define supports for the treads 172 while the vertical plates define back supports for a tread closing panel for the stairs. The plates 276 define spaced-apart openings 278 for receiving threaded fasteners for securing treads 172 and back panels to the horizontal and vertical plates 276. A pair of receiver tubes 280 attach at a first end and an opposing second end of the riser arms 272. A collar 281 attaches on an inward face of the receiver tube 280 extending towards the opposing receiver tube. A pair of railing receivers 282 attach laterally of the receiver tubes 280 at the first end and laterally of a leg receiver tube 284 at the second end of the riser arm. A threshold arm 286 extends from the second end of the riser arm. The intermediate riser arm 273 includes a support tube 288 attached to the plate 276 proximate the second end aligned transverse with the collars 281. A pair of elongate tubes 289 insert between the collar 281 and the support tube 288. The tubes 289 connected to the support tube 288 and the opposing collars 281 provide lateral stability for side rails that attach in the rail receives 282. A pair of transverse supports 290 engage the opposing first and second ends of the stair riser 270. The transverse supports 290 have an elongated transverse member 292 with three spaced-apart pegs 294. The pegs 294 of a first transverse support 290 engage open lower ends of the respective receiver tubes 280 at the first end of the stair riser 270. The pegs 294 of a second transverse support 290 engage the threshold arms 286 at the second end of the stair riser. Treads 172 (and back panels) seat on or against the horizontal or vertical plates 276, and screws extend through the plates and into the treads to secure the treads to the plates. The lowermost tread attached to the threshold arms 286 defines a landing at or proximate the ground surface. The threshold arms 286 may flex, or secure with bolts, in order to angle the lowermost step towards the ground to In an alternate embodiment, the lowermost tread support arms bolt to the riser arms 170 to facilitate walking transition from ground to tread or from tread to ground.

Figure 12:
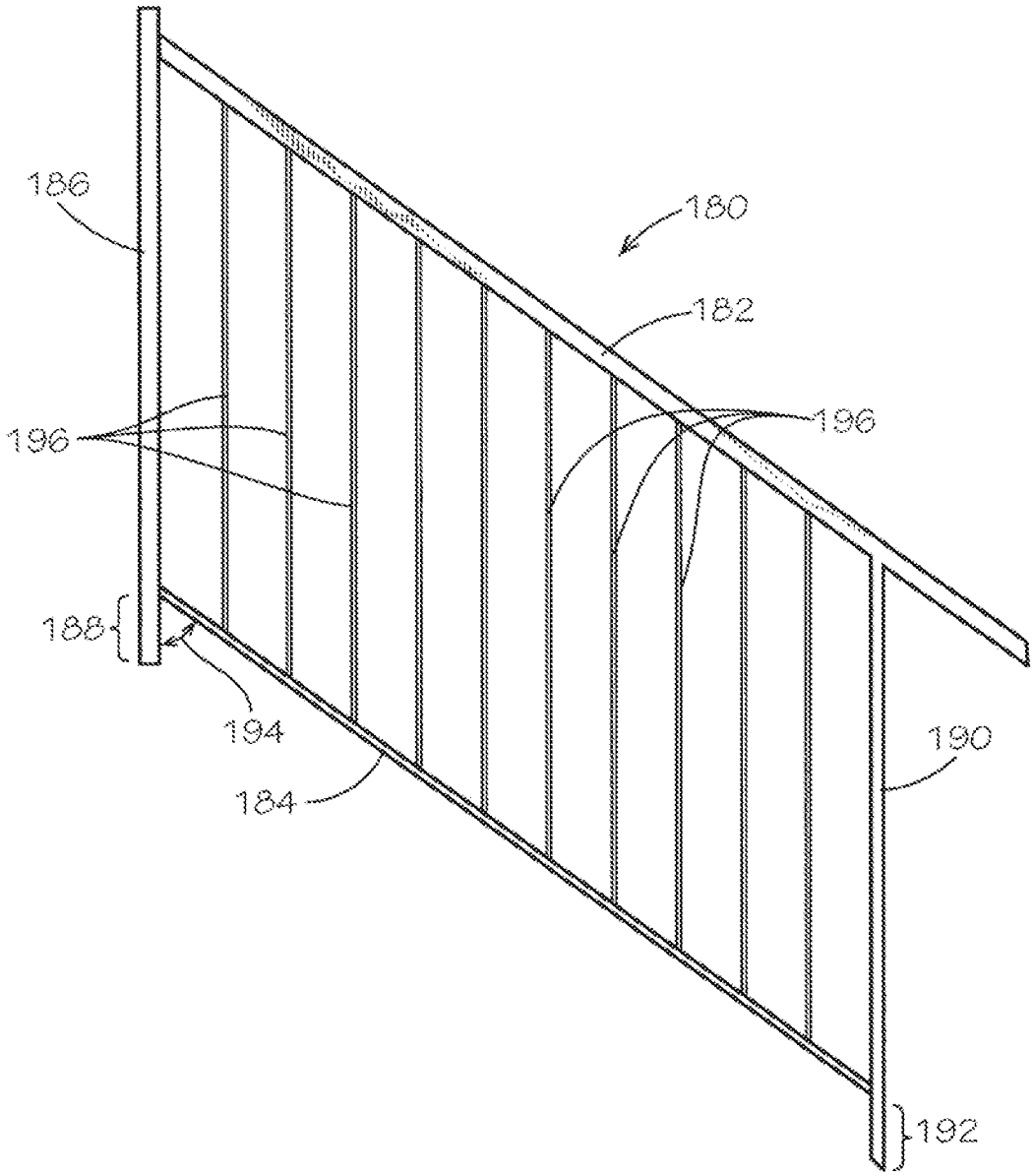
FIG. 12 illustrates a stair railing for attaching to the stair riser illustrated in FIG. 11.

FIG. 12 illustrates a stair railing 180 for attaching to the stair riser 160 illustrated in FIG. 11. The stair railing 180 has a hand rail 182 and a spaced-part bottom rail 184. An upper support member 186 attaches to the ends of the hand rail 182 and bottom rail 184 with a portion extending as a leg 188 below the bottom rail. A lower support member 190 attaches to the hand rail 182 and the end of the bottom rail 184 with a leg 192 extending below the bottom rail. The hand rail 182 and the bottom rail 184 attach at an angle 194 to the upper and lower support members 186, 190, for aligning with the vertical and horizontal offsets of the treads in the stairs module 24. A plurality of spaced-apart rods 196 extend between and attach at distal ends to the hand rail 182 and the bottom rail 184. The rods 196 are 0.25 inch diameter steel rods. For example, the rods 196 may attach to the bottom rail and insert into spaced-apart openings in a bottom surface of the handrail 182.

The modular decking apparatus 20 assembles as a deck that may be free-standing on the ground 25 with one or more deck modules 22 connected together and may include at least one stairs module 24. With reference to FIG. 6, the deck boards 32 attach to the upper surface of the top frame 90. The deck boards are positioned transverse to the end members 92 and the support members 96. A first deck board 32 is placed on the upper surface with a side edge aligned with one of the side member 94 and opposing ends aligned with the opposing end members 92. Placement holes are drilled into the deck board in alignment with the underlying end member 92 and the support members 96. Self-taping screws extend through the drilled holes and into the end members 92 and the support members 94 to secure the deck board 32 to the top frame and thereby defining the deck surface. Additional deck boards are placed sequentially on the top frame 92 abutted to or slightly spaced from the adjacent secured deck board 32. For each, the installer drills placement holes that then receive fasteners and the fasteners screwed into the underlying end members 92 and the support members 94. Preferably the deck boards 32 may be attached to the top frame 90 during manufacture at a manufacturing plant and shipped as an assembled unit for field installation. Alternatively, it is to be appreciated that field installation of elongated deck boards across multiple adjacent deck module boxes further secure the deck modules 22 together (for example, an elongated deck board that extends over and attaches to the top frames of three deck modules 22 assists in interlocking the three adjacent modules together unitarily). As noted above, the deck boards 32 may be wood, plastic, or composite material.

With reference to FIGS. 2-6, the deck module 22 assembles with opposing brace frames 26 (FIG. 2) (or 66, FIG. 3) interconnected with opposing connector bases 28 (FIG. 4) and the top frame 90 (FIG. 5) having the attached deck boards 32, with legs 80 (FIG. 6) for selectively setting the height of the deck module 22. First, the height of the deck is determined. Typically, the walk-on surface of the deck (i.e., the top surface of the deck boards 32 attached to the top frame 90) is positioned slightly below the threshold of the doorway to the manufactured building; for example, no more than about 7½ inches lower than the threshold. This provides a step from the deck surface into the doorway and being below the threshold, water does not flow from the deck surface through the doorway. A measurement is made to determine a distance H between a selected deck height below the threshold and the ground. The legs 80 are then attached to one of the brace frames 66. The legs 80 provide adjustability for vertical spacing of the deck 20. The vertical member 82 of the leg inserts into the leg receiver 58 that will be positioned next to the building sufficiently for the extending leg and the length of the vertical member 50 to equal the height H. The leg 80 is secured in place with a self-tapping fastener extending through the guide hole 58 and into the member 82. Another leg 80 is inserted into the opposing leg receiver 58 sufficiently so that the decking will be level or have a slight slope downwardly away from the building.

A second brace frame is prepared with adjustable legs 80. If the deck is to have another deck module 22 positioned adjacent to the first, the brace frame 26 is used. The brace frame 26 includes receivers 54, 56 for interconnecting with the adjacent deck module. Otherwise, the brace frame 66 may be used. The legs 80 are similarly inserted and secured in the leg receivers 58 sufficiently to maintain the deck surface level. That is, a height is determined for the brace frame next to the building so that the adjustable leg 80 inserts sufficiently into the receiver 58. The height outward of the building is similarly determined and the leg 80 inserted and secured in the opposing leg receiver 58 outwardly of the building.

The opposing brace frames then connect together using a pair of the connector bases 28. The legs 72 of the bases 28 insert into the opposing lower open ends of the vertical members 50 on the opposing brace frames. The deck frame 90 with the attached deck boards sits on top with the posts 98 inserted into the open upper ends of the vertical members 50. A stake or screw as appropriate inserts through the opening 86 of the plate 84 to secure the leg 80 to the ground (or ground surface such as concrete, asphalt or wood) and resists movement of the deck.

If the deck is to have an adjacent module, the brace frame 26 or 66 is prepared. The brace frame 26 is used if that module is to continue to a subsequent module; otherwise the brace frame 66 may be used. The brace frame in the prior deck module is also used for the support brace frame for the next adjacent deck module.

Adjacent deck modules 22 connect together with fasteners that secure the adjacent components of the deck module boxes together; i.e., fasteners secure through the aligned openings 100 in the end members 92 of end-to-end adjacent deck modules; of aligned openings 102 in the side members 94 and/or aligned openings 74 in the connector bases 28 of side-to-side adjacent deck modules; and adjacent posts 50 and spans 50 of adjacent deck modules. Also, a respective set of openings 100 or 102 may be used for attaching the stair riser 160 to an end or a side of a particular deck module 22.

The stairs module 24 attaches to one of the deck modules 22. First, the vertical spacing of the stair riser 160 is accommodated by installing a respective one of the legs 80 into the leg receiving tubes 176. The leg 80 is secured with a fastener in a selected position based on the determination discussed above for the height of the deck. The stair riser attaches to the deck module 22 by inserting the upper railing support tubes 174 into the open end of the respective receivers 54. It is to be noted that the brace frame 26 is used for the deck module 22 that engages the stairs module 24, with the receivers 54, 56 outwardly for receiving the upper railing support tubes 174 of the stair riser 160. With each of the end members 92 and side members 94 having the openings 100, 102 respectively, the stair riser 160 readily installs on either the end or the side of the deck module with bolts that extend through the respective openings (100 or 102) into the upper transverse member 166 of the stair riser 160. The upper transverse member 166 includes openings that align the respective openings 100 or paired openings 102 in the end and side members 92, 94, respectively.

Railings may attach to an upper surface of the deck 20 on perimeter portions for preventing persons from stepping off or falling off the elevated deck. The railings assemble with a plurality of the elongated railing 150 that interconnect with end posts 112, midposts 114, and corner posts 116. One of the end posts 112 positions on the deck as a starting point for the railing. Fasteners through the openings 126 secure the end post 112 to a deck board 32. For an adjacent corner, one of the corner posts 116 attaches to a first end of one of the railings 150 by insertion of the stubs 128 into the open ends of the top and bottom rails 152, 154. The stubs 128 in the end post 112 insert into the open ends of the top and bottom rails 152, 154 at the opposing end of the railing 150. The corner post 116 positions on a corner of the deck module and secures in place with fasteners though the openings 126 into the deck board 32. The stubs 128 received in the open ends of the rails, with placement and securing of the post to the deck board, assembles the side perimeter railing without having to separately fasten the rails to the posts such as with set screws. In an alternate embodiment, the stubs 128 are open-ended tubes that extend laterally from the post as an open collar. The top and bottom rails insert into the respective collar. A fastener (such as a screw threadly inserted from a bottom portion) may secure the top and bottom rails within the collar.

The midpost 114 connects intermediate two railings 150 on portions of the deck having two adjacent deck modules 22. Continuing with the example in the preceding paragraph, one of of the midposts 114 connects to an end of another railing 150. The stubs 128 insert into the open ends of the top and bottom rails. The stubs 128 extending from the corner post 116 extend into the opposing open ends of the rails. The midpost 114 stands on the proximate deck board 32. Fasteners extend through the openings 126 to secure the midpost 114 to the deck board.

The railing members are further similarly joined with the stubs 128 and the open ends of the railings 152, 154 in perimeter portions of the deck with the appropriate end posts 112, midposts 114 and corner posts 116 secured to the deck boards.

The stairs railing 180 attaches to the stair riser 160. The upper railing support tube 174 receives the leg 188 of the stairs railing 180 and the lower railing support tube 178 receives the leg 192. The railing 180 may be secured with fasteners, such as self-drilling screws drilled through the support tube 174, 178 and into the leg 188, 192, respectively.

Figure 13:
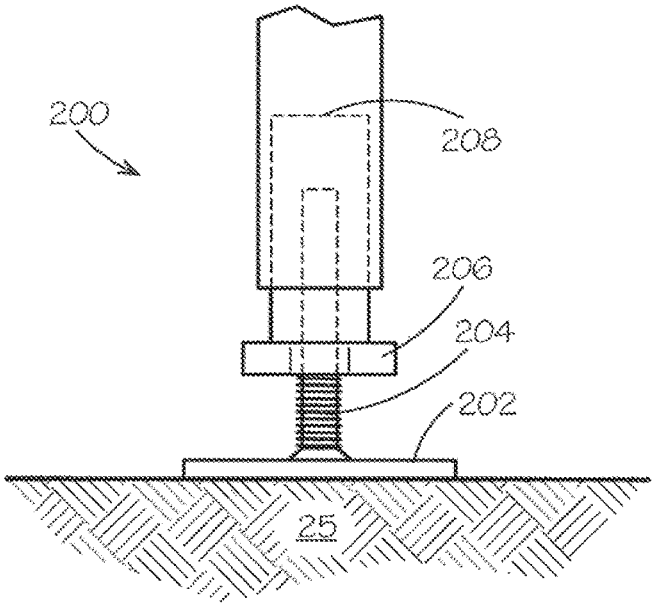
FIG. 13 illustrates a first adjustable leg for selectively setting a foot in contact with the ground.

FIG. 13 illustrates a first adjustable leg 200 for selectively setting a foot 202 in contact with the ground 25. A threaded rod 204 welds vertically to the foot 202, and receives a nut 206 attached to a lower end of an insert post 208. The open end of the post 50 of the brace frame receives the insert post 208. The distance between the foot 202 and the post 50 may be adjusted by rotating the nut 206 on the threaded rod 204 for selectively positioning the foot 202 on the ground 25.

Figure 14:
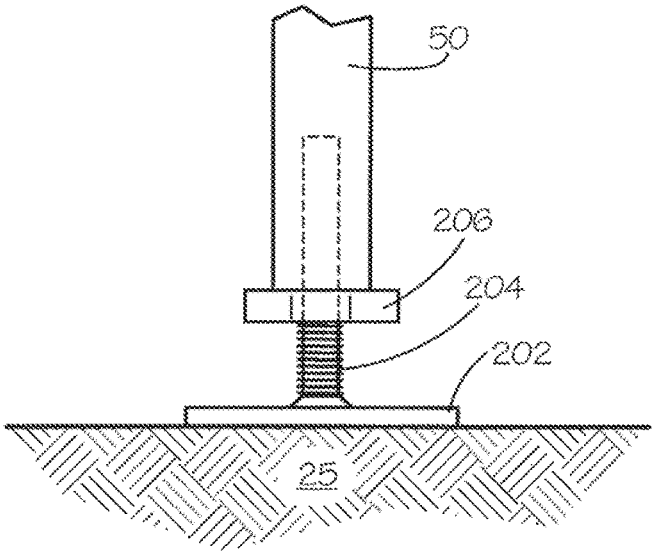
FIG. 14 illustrates a second adjustable leg for selectively setting a foot in contact with the ground.

FIG. 14 illustrates a second adjustable leg 210 for selectively setting the foot 202 in contact with the ground. For one embodiment, the nut 206 attaches to a lower end of the post 50. The threaded rod 204 rotatably inserts into the post 50 on rotation through the nut 206 for selectively positioning the foot 202 on the ground 25. In a second embodiment, the nut 206 is not attached to the post 50, but freely movable on the threaded rod 204 for bearing movement on the post 50 for selective height adjustment, for example, adjusting for post-installation settlement to keep the foot bearing on the ground 25. The nut 206 is dimensionally larger than the cross-section of the post 50 that seats on the nut.

Figure 15:
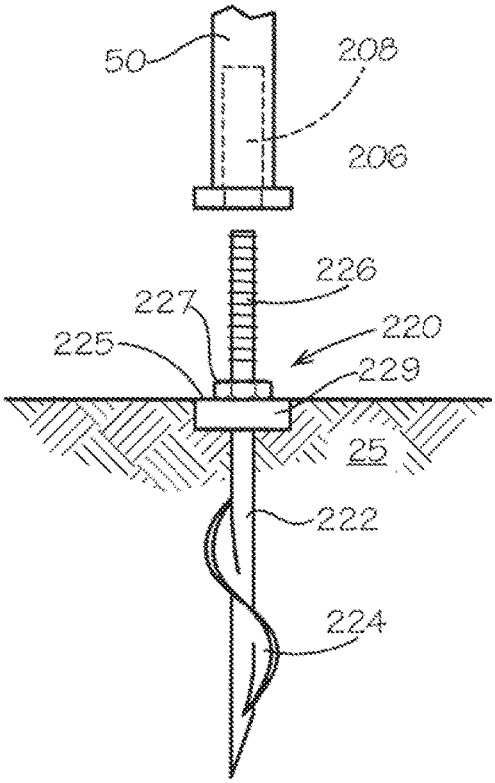
FIG. 15 illustrates a ground anchor for securing the deck module or stair module fixedly to the ground with a helix disposed below a frost line as a pier for holding the structure up and resisting uplift and movement.

FIG. 15 illustrates a ground anchor 220 for securing the deck module 22 (or the stairs module 24) to the ground 25, such as for use in geographical areas susceptible to ground freeze. The ground anchor includes an elongated shaft 222 having helical flights 224 for driving the ground anchor below grade during installation. A cap 225 that is open towards the ground 25 seats on the shaft and a nut 227 welds in place. The cap 225 includes a depending side wall 229 for bearing engagement with the ground 25. The nut 227 receives a socket of a power driven tool for drilling the anchor 220 into the ground 25. An opposing end of the shaft 222 is threaded 226, which receives the nut 206 of the insert post 208. The post 208 inserts into the vertical member 50 of the deck module 22 (or the leg receiver 176 of the stair riser 160). Rotation of the nut 206 on the threaded end 226 adjusts the height of the deck module or stair riser relative to the ground 25. Attachment of the deck module or the stairs module to the ground anchor 220 secures the deck 20 in cold climates, as well as resisting movement from winds and prevents settling. The ground anchor holds the deck module or stair module up and keeps the deck module or stairs module secured to the ground.

Figure 16:
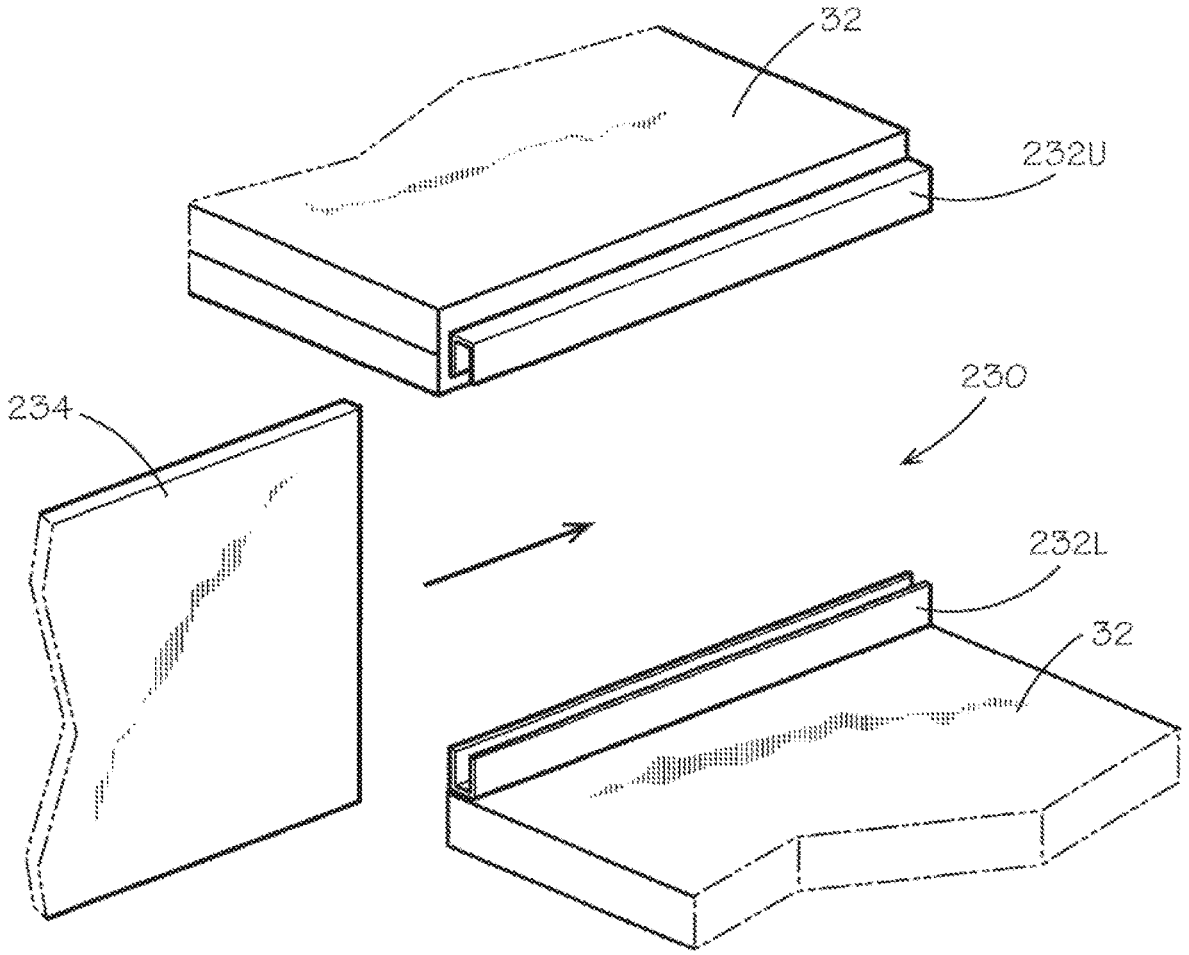
FIG. 16 illustrates a panel closing assembly, illustrated with closing an open gap between adjacent treads of the stair riser.

FIG. 16 illustrates a panel closing assembly 230 having opposing U-channels 232 that receive a panel 234 for closing an open gap between adjacent treads of the stair riser. A first U-channel 232U mounts to a forward portion of a first tread 32 while an opposing second U-channel 232L mounts to a rearward portion of a second adjacent lower tread 32. The panel 234 slides laterally into the opposing channels 232 for closing the open gap between the treads.

Similar U-channels may gainfully close the open side between the deck boards and the connector base 28 of the deck modules 22.

The brace frames may be provided selectively for different base heights adjustable within a range by the adjustable legs 80. The vertical members 50 in the illustrated embodiment have lengths selected as 22.5 inches, 30 inches, and 37.5 inches, in order to provide for deck heights when using the legs 80 in ranges of between about 22.5 inches to about 30 inches, from about 32 inches to about 39.5 inches, and from about 37.5 inches to about 45 inches, respectively. These ranges accommodate a step gap between the deck board 32 and the threshold of the doorway into the building. Also, the brace frames 26, 66 in the different heights allows decks made with multiple modules to have a portion of a first height and a second portion of a second height.

Figure 17:
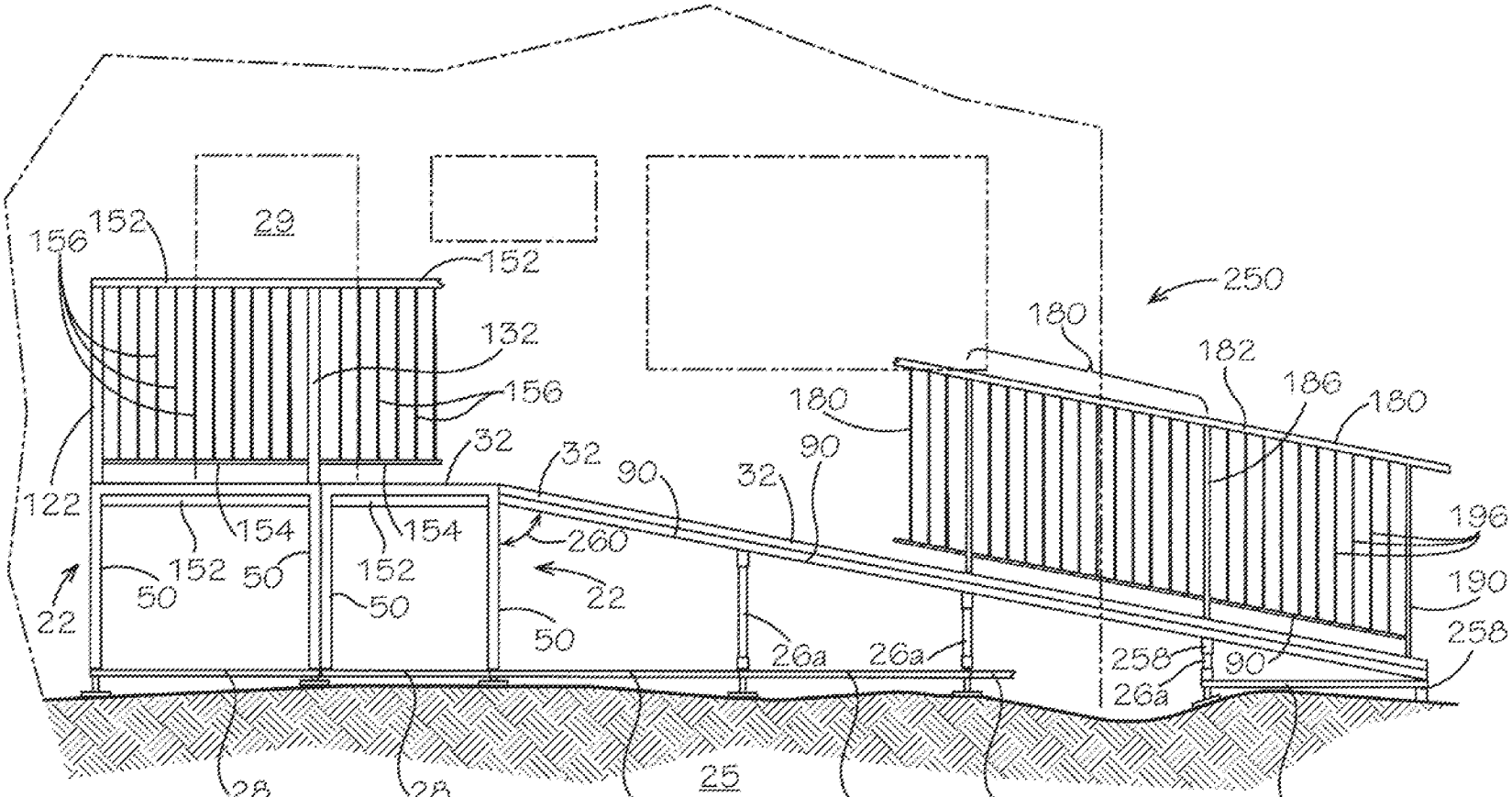
FIG. 17 illustrates in side elevational view an embodiment of a module deck with a ramp using deck modules of the present invention modified with opposing different heights to construct a sloping ramp from a ground level to a deck level.

With reference to FIG. 17, the deck assembly 20 may be configured with an elongated ramp 250 having a slope angle 252 (rise over run) suitable for movement of a wheelchair (manual or powered) or a mobility device, such as a scooter or battery-operated wheeled vehicle. Such ramp may have a rise over run at about a 4 degree angle to no more than about a 7 degree angle, based on recommendations of disability organizations and ramp specification guidelines. Preferably, the slope is 1:12 providing 1 inch of vertical rise per 12 inch length of ramp, or about a 5 degree incline. Thus, a deck height of 36 inches would preferably have a ramp length of 36 feet. In an alternate embodiment, an elongated grab rail (not illustrated) readily installs for hand-gripping/hand-sliding movement when a person walks along the ramp, as may be required.

Figure 18A:
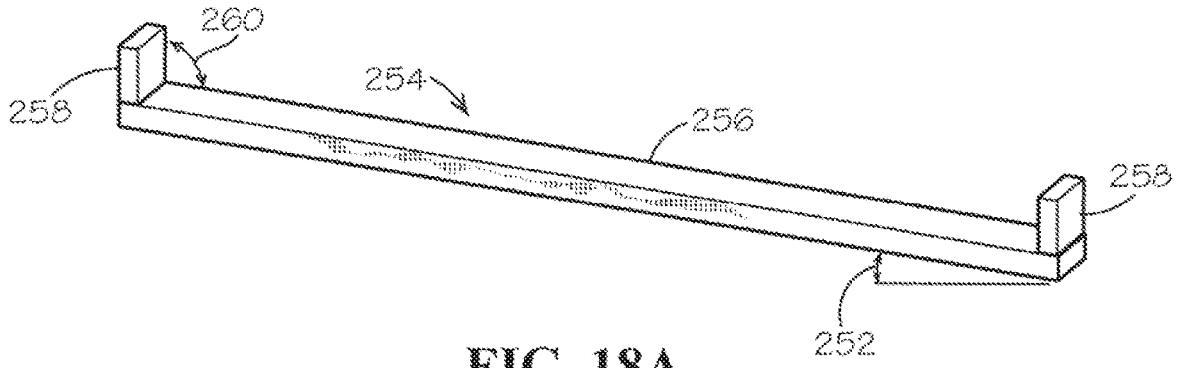
FIGS. 18A and 18B illustrate a ramp connector base in perspective view and in front elevational view, respectively, for use with the deck module illustrated in FIG. 1.
Figure 18B:
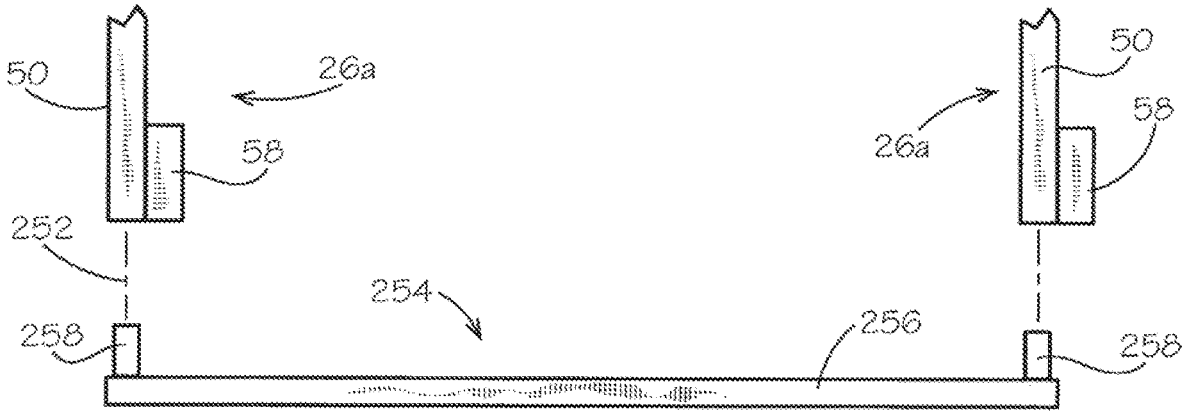

The ramp 250 assembles with deck ramp modules 22*a* in which adjacent brace frames 26 (or brace frame 66 at the lower leading end of the ramp) are of different heights and interconnected by opposing connector members 254 shown in perspective view in FIG. 18A and side elevational view in FIG. 18B. The connector member 254 is an elongate tube 256 having projecting legs 258 attached at respective distal ends and extending at an oblique angle 260 relative to the tube 256 in a first direction and parallel to the opposing leg. The oblique angle of the legs 258 define the slope angle 252 of the tube 256 while the legs 258 extend into the open upper ends of the vertical members 50 of the adjacent brace frames 26 (66), which open ends matingly receive the legs coaxially with the axis of the vertical members 50. The adjacent brace members of the deck ramp modules 22*a* receive top frames 90*a* modified in that the posts 98 are attached to the side members 92, 94 at the oblique angle based on the slope angle, for similar coaxial engagement with the receivers 54 of the brace frames 26.

In assembly of the ramp 250, the brace frames are sequenced selectively with decreasing heights (i.e, by decreasing the length of the vertical members 50, for example, or adjusting with the adjustable legs 200 (or 210) for progressively sloping the ramp from the deck level to a leading lower end of the ramp proximate the ground surface. As an illustrative example, a brace frame 26 at a first end of a deck ramp module 22*a* that has a run length of four (4) feet positions the deck at 36 inches; an opposing brace frame 26 (or 66) would be of a shorter length to position the deck at 32 inches; thus, the deck ramp slopes from the first end to the second end on a 1:12 slope. A plurality of the ramp modules interconnect in sequential adjacent relation to form the ramp of appropriate length. In an alternate embodiment, a deck module or multiple deck modules define an intermediate transition or switch-back between first and second ramp portions in the event the ground space does not accommodate a single run ramp in its full length. In such embodiment, the first portion has a downward slope in a first longitudinal direction and the second portion has a downward slope in a second longitudinal direction, for example, opposing and parallel to but spaced-apart from the first longitudinal direction or alternatively, at an angle to the first longitudinal direction such as an L-shaped ramp structure.

The adjustable legs 200 and 210 discussed above in reference to FIGS. 13 and 14 gainfully facilitate ramp height positioning in the plurality of sequenced ramp modules.

The present disclosure of the brace frames in a range of heights, the connector braces interconnect opposing brace frames, and the top frame, which interconnect as a deck module box, for deck boards to define a decking surface, the stairs risers, with railings and posts for perimeter deck installation, and for ramp connector braces for defining a sloped ramp, provide simple and readily assembled components for the modular deck apparatus, with multiple modules securely connected together for rigidity and stability of a deck, free-standing or ground secured, for an ornamental and structural addition for buildings and grounds. The elongated tubes used for the components are open-ended and of appropriate cross-section length and width for respective members to receive engaging portions as discussed above. Generally, the structural members and posts are 1 inch×1 inch square steel tubing, 1.25 inch×1.25 inch square steel tubing, or 0.75 inch×0.75 inch square steel tubing. The feet 84, 124 may be 3 inch by 3 inch by 0.1875 steel plate. The stubs 128 are 0.75 inch round tubing. The deck boards 32 may be 5/4 pressure treated wood or a plastic or composite material suitable for outdoor deck applications.

The disclosed invention provides a deck apparatus in a first form as a deck module that assembles from a pair of opposing brace frames, each brace frame having two opposing vertical members connected by a transverse members. The opposing brace frames are held in spaced-apart relation by a pair of opposing connector bases, each connector base having an elongated member with a pair of posts extending in a first direction from respective end portions of the elongated member, the posts for being received in a respective open end of the aligned vertical members of the opposing brace frames to hold the brace frames in spaced-relation. A plurality of deck boards attached to a deck board top frame provides a walking surface for the deck assembly, which deck board top frame has opposing end members and opposing side members attached at respective distal ends, and a plurality of projecting posts each extending from a respective connection of one of the end members and one of the side members, each of the posts for being received in an opposing upper end of a respective one of the vertical members of the opposing brace frame and the plurality of deck boards disposed between the end members. In an alternate embodiment, the deck board top frame further comprises at last one transverse member connected at opposing distal ends to the opposing side members, to provide intermediate support for the deck boards.

In another aspect, the deck apparatus comprises a second deck module configured for attaching to the first deck module to provide a larger deck area. The second deck module connects to one of the brace frames of the first deck module in which each of the vertical members of at least one of the brace frames further comprises a lower receiver and an upper receiver attached in spaced-apart relation to a respective first side of the vertical member. The second deck module uses a third brace frame having the two opposing vertical members connected by the transverse member. A second pair of opposing connector bases interconnect the third brace frame and the at least one base frame of the first module. Each connector base of the second pair have the elongated member with the pair of posts extending in the first direction from respective end portions of the elongated member. A respective first one of the pair of posts of the second pair of opposing connector bases are received in a respective open end of the lower receiver of the vertical members of the at least one of the brace frames and a respective second of the pair of posts of the second pair of opposing connector bases are received in a respective open end of the vertical members of the third brace frame to hold the at least one of the brace frames in spaced-relation to the third brace frame. A second deck board top frame has deck boards for the second deck module, which deck boards are disposed on the opposing end members and the opposing side members that attach at respective distal ends to form the deck board top frame. The plurality of projecting posts each extend from the respective connection of one of the end members and one of the side members. The posts are received in an open upper end of a respective one of the vertical members of the at least one of the brace frames and the third brace frame.

In another aspect, the deck apparatus may be configured with extension legs to accommodate seating of the brace frames in firm contact with a support surface, typically a ground surface proximate a building such as a manufactured building. This is accomplished by providing each of the vertical members of at least one of the brace frames a second lower receiver attached to a respective second side of the vertical member. The second lower receiver receives a leg member of a leg device. The leg device includes a plate a plate for bearing support on a surface and a leg member such as an elongated tube, connected at a first end to the plate and an opposing second end for being received in the open lower end of a respective one of the second lower receivers. The leg member is received into the second lower receiver and positioned with the plate in contact with the ground. A fastener driven through the vertical of the base frame and into the leg member secures the leg device at a selected length. The plate may further include an opening for receiving a support connector therethrough. The support connector may be a ground anchor with a threaded end that extends through the opening and receives a nut, a stake driven through the opening into the ground, a screw driven through the opening into the ground, or other fastener to secure the plate in contact with the ground.

The deck apparatus may include a stairs riser assembly for being attached at a first end to the deck board top frame and an opposing second end for bearing on a support surface vertically lower than the deck board top frame after attaching the first end to the deck board top frame. The stairs riser comprises a pair of opposing riser arms, each riser arm having an upper post attached at an oblique angle at the first end. A plurality of transverse supports are disposed in spaced-apart relation and connect at opposing ends between the pair of opposing riser arms. A plurality of pairs of tread support arms attach at a first end in aligned relation to the opposed riser arms and extend outwardly as a cantilever. The pairs of tread support arms are disposed in space-apart relation to the riser arms and a tread member, such as a wood, plastic, or metal planar member or board attaches to a respective pair of aligned tread support arms. One or more leg members may further support the stair risers based on ground slope. A leg receiving member attaches to a respective one of the riser arms proximate the opposing second end of the stair risers, for receiving a leg member in the receiving member and positioned for bearing contact with a support surface. A fastener secures the leg member to the leg receiving member.

In another aspect, the deck apparatus uses a ramp assembly to provide a walkable ramp sloped at an angle appropriate for wheelchairs and personal walking mobility devices. The ramp assembly assembles with a plurality of ramp brace frames. Each ramp brace frame has two opposing vertical members connected by a transverse member and sequentially the ramp brace fames has differing heights. The ramp frame braces are disposed in spaced-apart relation along the rampway sequentially to define a slope line across the upper ends of the ramp brace frames. The vertical members in a first one of the plurality of ramp brace frames has a first length and the vertical members in each of the subsequent ones of the plurality of ramp brace frames have a respective second length, which said respective second length is less than the first length and said respective second length of a first one of the subsequent plurality of the ramp brace frames greater than the second length of a second one of the subsequent plurality of ramp brace frames. The ramp assembly includes a plurality of ramp connector bases for connecting adjacent ramp brace frames. Each ramp connector base has an elongated member with a pair of posts extending at an oblique angle in a first direction from respective end portions of the elongated member, The posts are received in a respective open end of a respective first vertical member of a first one of the plurality of ramp brace frames and in a respective open end of a respective second vertical member of a second one of the plurality of ramp brace frames to hold said first and second one of the plurality of ramp brace frames in spaced apart relation. In embodiments having more than two ramp brace frames, the intermediate ramp brace frames include a lower receiving tube attached to a face of the vertical member for receiving the post of the adjacent connector base for securing the spacing to the adjacent brace frame. A ramp deck board top frame has opposing end members and opposing side members which attach at respective distal ends. A plurality of projecting posts each extend from a respective connection of one of the end members and one of the side members at an oblique angle to conform to the slope of the ramp defined by the ramp brace frames. A plurality of deck boards disposed between the end members attach with fasteners to the end and side members. Each of the posts for being received in an opposing upper end of a respective one of the vertical members of said first and second ones of the plurality of ramp brace frames in spaced apart relation.

The foregoing has disclosed a deck apparatus readily assembled on site at a building such as a just-installed manufactured building and provides convenient access into the building with the optional stairs and/or ramp modules disclosed herein, while railings may be secured to the deck board surface to restrict persons from stepping off of the deck surface at a height above the ground, including corner posts, end posts, and midposts for supporting elongate railing assemblies. Variations and changes thereto may be made to deck apparatus and its components within the scope of the appended claims.

What is claimed is:

1. A deck apparatus, comprising:

a pair of opposing brace frames, each brace frame having two opposing vertical members connected by a transverse member, said base frames for disposing in spaced relation;

a pair of opposing connector bases, each connector base having an elongated member with a pair of posts extending in a first direction from respective end portions of the elongated member, the pair of posts for being received in a respective open end of the vertical members of the opposing brace frames to hold the brace frames in spaced-relation;

a deck board top frame having opposing end members and opposing side members attached at respective distal ends, a plurality of projecting deck posts each extending from a respective connection of one of the end members and one of the side members, and each of the deck posts for being received in an opposing upper end of a respective one of the vertical members of the opposing brace frames;

a ramp assembly for being attached at a first end proximate the deck board top frame and an opposing second end for bearing on a support surface vertically lower than the deck board top frame after attaching the first end thereto, said ramp assembly comprising:

a plurality of ramp brace frames, each ramp brace frame having two opposing vertical ramp members connected by a transverse ramp member, the vertical ramp members in a first one of the plurality of ramp brace frames having a first length and the vertical ramp members in each of a subsequent one of the plurality of ramp brace frames having a respective second length, said respective second length less than the first length and said respective second length of a first one of a subsequent plurality of the ramp brace frames greater than the second length of a second one of the subsequent plurality of ramp brace frames;

a plurality of ramp connector bases, each ramp connector base having an elongated base member with a pair of base posts extending at an oblique angle in a first direction from respective end portions of the elongated base member, the base posts for being received in a respective open end of a respective first vertical ramp member of a first one of the plurality of ramp brace frames and in a respective open end of a respective second vertical ramp member of a second one of the plurality of ramp brace frames to hold said first and second one of the plurality of ramp brace frames in spaced apart relation;

a ramp deck board top frame having opposing end members and opposing side members attached at respective distal ends, a plurality of projecting ramp deck posts each extending from a respective connection of one of the end members and one of the side members, each of the ramp deck posts for being received in an opposing upper end of a respective one of the vertical ramp members of said first and second ones of the plurality of ramp brace frames in spaced apart relation; and a plurality of deck boards for disposing in adjacent relation between the end members of the deck board top frame and the ramp deck board top frame.

2. The deck apparatus as recited in claim 1, wherein the deck board top frame further comprises at last one transverse member connected at opposing distal ends to the opposing side members.

3. The deck apparatus as recited in claim 1, wherein each of the two vertical members of at least one of the brace frames further comprises a first lower receiver attached to a respective first side of the vertical member; and further comprising:

a third brace frame having the two opposing vertical members connected by the transverse member; and a second pair of opposing connector bases, each connector base having the elongated member with the pair of posts extending in the first direction from respective end portions of the elongated member, a respective first one of the pair of posts of the second pair of opposing connector bases for being received in a respective open end of the first lower receiver of the vertical members of the at least one of the brace frames and a respective second of the pair of posts of the second pair of opposing connector bases for being received in a respective open end of the vertical members of the third brace frame to hold the at least one of the brace frames in spaced-relation to the third brace frame;

a second deck board top frame having the opposing end members and the opposing side members attached at respective distal ends, the plurality of projecting deck posts each extending from the respective connection of one of the end members and one of the side members, and each of the deck posts for being received in an open upper end of a respective one of the vertical members of the at least one of the brace frames and the third brace frame; and a second plurality of deck boards disposed between the end members of the second deck board top frame.

4. The deck apparatus as recited in claim 1, wherein each of the vertical members of at least one of the brace frames further comprises a lower receiver attached to a respective second side of the vertical member; and further comprising:

a pair of legs, each comprising:

a plate for bearing support on a surface; and a leg member connected at a first end to the plate and an opposing second end for being received in an open lower end of a respective one of the lower receivers and being secured at a selected length.

5. The deck apparatus as recited in claim 4, wherein the plate further comprises an opening for receiving a support connector therethrough.

6. The deck apparatus as recited in claim 1, further comprising a stairs riser assembly for being attached at a first end proximate the deck board top frame and an opposing second end for bearing on a support surface vertically lower than the deck board top frame after attaching the first end thereto.

7. The deck apparatus as recited in claim 6, wherein each of the two vertical members of at least one of the pair of brace frames further comprises an upper receiver attached to the respective first side of the vertical member spaced apart from the lower receiver; and the stairs riser assembly, comprising:

a pair of opposing riser arms, each riser arm having a riser post attached at an oblique angle at the first end, said riser post for being received in a respective upper receiver of the at least one of the pair of brace frames;

a plurality of transverse supports disposed in spaced-apart relation between the pair of opposing riser arms; and a plurality of pairs of tread support arms, each pair of tread support arms attached at a first end in aligned relation to the opposed riser arms and extending as a cantilever therefrom, the pairs of tread support arms disposed in space-apart relation; and a plurality of treads, each tread for attaching to a respective pair of aligned tread support arms.

8. The deck apparatus as recited in claim 7, further comprising a pair of leg receiving members each attached to a respective one of the riser arms proximate the opposing second end of the stair riser assembly, for receiving a leg member for bearing contact with a support surface.

9. The deck apparatus as recited in claim 8, wherein the leg member comprises:

a plate; and a leg member connected at a first end to the plate and an opposing second end for being received in an open lower end of a respective one of the leg receiving members and being secured thereto at a selected length.

10. The deck apparatus as recited in claim 1, further comprising a pair of a railing assembly for attaching in opposing spaced relation at respective first ends to a one of the plurality of ramp brace frames and at respective second ends to an adjacent one of the plurality of ramp brace frames.

11. The deck apparatus as recited in claim 10, wherein each rail assembly comprises:

a hand rail;

a bottom rail;

a plurality of spaced apart rods attached a respective distal ends to the hand rail and the bottom rail, said hand rail and bottom rail attach at an angle relative to the rods for conforming to a slope of the ramp assembly.

12. The deck apparatus as recited in claim 1, further comprising:

a second pair of upper receivers each attached to a respective first side of a respective one of the two opposing vertical members of at least one of the pair of opposing brace frames;

a stairs riser assembly for being attached at a first end proximate the deck board top frame and an opposing second end for bearing on a support surface vertically lower than the deck board top frame after attaching the first end thereto, said stairs riser assembly comprising:

a pair of opposing riser arms, each riser arm having a riser post attached at an oblique angle at the first end, said riser post for being received in an open end of a respective one of the second pair of upper receivers;

a plurality of transverse supports disposed in spaced-apart relation between the pair of opposing riser arms; and a plurality of pairs of tread support arms, each pair of tread support arms attached at a first end in aligned relation to the opposed riser arms and extending as a cantilever therefrom, the pairs of tread support arms disposed in spaced-apart relation; and a plurality of treads, each tread for attaching to a respective pair of aligned tread support arms.

13. The deck apparatus as recited in claim 12, further comprising a pair of leg receiving members each attached to a respective one of the riser arms proximate an opposing second end of the stair riser assembly, for receiving a leg member for bearing contact with a support surface.

14. The deck apparatus as recited in claim 13, wherein the leg member comprises:

a plate; and a leg member connected at a first end to the plate and an opposing second end for being received in an open lower end of a respective one of the leg receiving members and being secured thereto at a selected length.

15. The deck apparatus as recited in claim 12, wherein the deck board top frame further comprises at last one transverse member connected at opposing distal ends to the opposing side members.

16. The deck apparatus as recited in claim 12, wherein each of the vertical members of at least one of the brace frames further comprises a first lower receiver attached spaced-apart from the upper receiver to the respective first side of the vertical member; and further comprising:

a third brace frame having the two opposing vertical members connected by the transverse member; and a second pair of opposing connector bases, each connector base having the elongated member with the pair of posts extending in the first direction from respective end portions of the elongated member, a respective first one of the pair of posts of the second pair of opposing connector bases for being received in a respective open end of the first lower receiver of the vertical members of the at least one of the brace frames and a respective second of the pair of posts of the second pair of opposing connector bases for being received in a respective open end of the vertical members of the third brace frame to hold the at least one of the brace frames in spaced-relation to the third brace frame;

a second deck board top frame having the opposing end members and the opposing side members attached at respective distal ends, the plurality of projecting deck posts each extending from the respective connection of one of the end members and one of the side members, and each of the deck posts for being received in an open upper end of a respective one of the vertical members of the at least one of the brace frames and the third brace frame; and a second plurality of deck boards disposed between the end members.

17. The deck apparatus as recited in claim 12, wherein each of the vertical members of at least one of the brace frames further comprises a second lower receiver attached to a respective second side of the vertical member; and further comprising:

a pair of legs, each leg comprising:

a plate for bearing support on a surface; and a leg member connected at a first end to the plate and an opposing second end for being received in the open lower end of a respective one of the second lower receivers and being secured at a selected length.

18. The deck apparatus as recited in claim 17, wherein the plate further comprises an opening for receiving a support connector therethrough.

19. A deck apparatus, comprising:

a pair of brace frames, each brace frame having two opposing vertical members connected by a transverse member, said base frames for disposing in opposing spaced relation;

a pair of connector bases, each connectable at a first end and a second end to a respective one of the brace frames for holding the brace frames in spaced-relation;

a deck board top frame having opposing end members and opposing side members attached at respective distal ends, and configured for receiving the respective upper ends of the vertical members of the opposing brace frames held in spaced-apart relation;

a ramp assembly for being attached at a first end proximate the deck board top frame and an opposing second end for bearing on a support surface vertically lower than the deck board top frame after attaching the first end thereto, said ramp assembly comprising:

a plurality of ramp brace frames, each ramp brace frame having two opposing vertical ramp members connected by a transverse ramp member, the vertical ramp members in a first one of the plurality of ramp brace frames having a first length and the vertical ramp members in each of a subsequent one of the plurality of ramp brace frames having a respective second length, said respective second length less than the first length and said respective second length of a first one of a subsequent plurality of the ramp brace frames greater than the second length of a second one of the subsequent plurality of ramp brace frames;

a plurality of ramp connector bases each connectable at a first end and a second end to a respective first and second one of the plurality of ramp brace frames for holding the first and second one of the plurality of ramp brace frames in spaced apart relation;

a ramp deck board top frame having opposing end members and opposing side members attached at respective distal ends configured for receiving the respective upper ends of the vertical ramp members of said first and second ones of the plurality of ramp brace frames; and a plurality of deck boards for disposing in adjacent relation between the end members of the deck board top frame and the ramp deck board top frame.

20. The deck apparatus as recited in claim 19, wherein each connector base comprises an elongated member with a pair of posts extending in a first direction from respective end portions of the elongated member, the pair of posts for being received in a respective open end of the vertical members of the opposing brace frames to hold the brace frames in spaced-relation.

21. The deck apparatus as recited in claim 19, wherein the deck board top frame further comprises a plurality of projecting deck posts each extending from a respective connection of one of the end members and one of the side members, and each of the deck posts for being received in an opposing upper end of a respective one of the vertical members of the opposing brace frames.

22. The deck apparatus as recited in claim 19, wherein each ramp connector base comprises an elongated base member with a pair of base posts extending at an oblique angle in a first direction from respective end portions of the elongated base member, the base posts for being received in a respective open end of a respective first vertical ramp member of a first one of the plurality of ramp brace frames and in a respective open end of a respective second vertical ramp member of a second one of the plurality of ramp brace frames to hold said first and second one of the plurality of ramp brace frames in spaced apart relation.

23. The deck apparatus as recited in claim 19, wherein the ramp deck board top frame further comprises a plurality of projecting ramp deck posts each extending from a respective connection of one of the end members and one of the side members, each of the ramp deck posts for being received in an opposing upper end of a respective one of the vertical ramp members of said first and second ones of the plurality of ramp brace frames.

24. The deck apparatus as recited in claim 19, wherein each of the two vertical members of at least one of the brace frames further comprises a first lower receiver attached to a respective first side of the vertical member; and further comprising:

a third brace frame having the two opposing vertical members connected by the transverse member; and a second pair of opposing connector bases, each connector base having the elongated member and configured for holding the at least one of the brace frames in spaced-relation to the third brace frame; and a second deck board top frame having the opposing end members and the opposing side members attached at respective distal ends, and configured for receiving the respective upper ends of a respective one of the vertical members of the at least one of the brace frames and the third brace frame; and a second plurality of deck boards disposed between the end members of the second deck board top frame.

* * * * *